US010257640B2

(12) United States Patent
Franck

(10) Patent No.: US 10,257,640 B2
(45) **Date of Patent: *Apr. 9, 2019**

(54) DEVICE AND METHOD FOR PROCESSING A SIGNAL IN THE FREQUENCY DOMAIN

(71) Applicant: Fraunhofer-Gesellschaft zur Foerderung der angewandten Forschung e.V., Munich (DE)

(72) Inventor: Andreas Franck, Ilmenau (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/896,293

(22) Filed: Feb. 14, 2018

(65) Prior Publication Data

US 2018/0199145 A1 Jul. 12, 2018

Related U.S. Application Data

(63) Continuation of application No. 15/264,756, filed on Sep. 14, 2016, which is a continuation of application No. PCT/EP2015/055094, filed on Mar. 11, 2015.

(30) Foreign Application Priority Data

Mar. 14, 2014 (EP) ..... 14159922
Jul. 21, 2014 (DE) ..... 10 2014 214 143

(51) Int. Cl.
*H04S 7/00* (2006.01)
*H04S 3/00* (2006.01)
*G10L 19/022* (2013.01)

(52) U.S. Cl.
CPC ..... *H04S 7/307* (2013.01); *G10L 19/022* (2013.01); *H04S 3/004* (2013.01); *H04S 7/30* (2013.01);
(Continued)

(58) Field of Classification Search
USPC ..... 381/71.14, 66, 71.12, 94.1, 94.7, 95, 96, 381/303, 359
See application file for complete search history.

(56) References Cited

U.S. PATENT DOCUMENTS 6,819,641 B1 * 11/2004 Terao ..... G11B 20/10527 369/44.27
6,895,095 B1 * 5/2005 Thomas ..... G10L 21/0208 379/406.12
(Continued)

FOREIGN PATENT DOCUMENTS

CN 101529502 B 7/2012
JP 2009-533910 A 9/2009

OTHER PUBLICATIONS

V. R. Algazi und R. 0. Duda, "Headphone-based spatial sound," IEEE Signal Processing Mag., Bd. 28, Nr. 1, S. 33-42, Jan. 2011.
(Continued)

*Primary Examiner* — Yosef K Laekemariam
(74) *Attorney, Agent, or Firm* — McClure, Qualey & Rodack, LLP

(57) ABSTRACT

A device for processing a signal includes a processor stage configured to filter the signal present in a frequency-domain representation by a filter with a filter characteristic in order to obtain a filtered signal, to provide the filtered or a signal derived from the filtered signal with a frequency-domain window function, in order to obtain a windowed signal, wherein providing has multiplications of frequency-domain window coefficients of the frequency-domain window function by spectral values of the filtered signal or the signal
(Continued)

derived from the filtered signal in order to obtain multiplication results, and summing up the multiplication results. Further, the device has a converter for converting the windowed signal or a signal determined using the windowed signal to a time domain in order to obtain the processed signal.

10 Claims, 13 Drawing Sheets

(52) U.S. Cl.
CPC ..... *H04S 2400/01* (2013.01); *H04S 2420/01* (2013.01)

(56) References Cited

U.S. PATENT DOCUMENTS

| | | | | |
|---|---|---|---|---|
| 8,036,903 | B2 | 10/2011 | Grill et al. | |
| 8,577,482 | B2 | 11/2013 | Herre et al. | |
| 2002/0073128 | A1 | 6/2002 | Egelmeers et al. | |
| 2005/0203730 | A1 | 9/2005 | Aoki et al. | |
| 2010/0191792 | A1* | 7/2010 | Brown ..... | G06F 17/148 708/404 |

OTHER PUBLICATIONS

R. Nicol, Binaural Technology, ser. AES Monographs. New York, NY: AES, 2010.
D. N. Zotkin, R. Duraiswami, und L. S. Davis, "Rendering localized spatial audio in a virtual auditory space," IEEE Trans. Multimedia, Bd. 6, Nr. 4, S. 553-564, Aug. 2004.
A. Härmä, J. Jakka, M. Tikander, et al., "Augmented reality audio for mobile and wearable appliances," J. Audio Eng. Soc., Bd. 52, Nr. 6, S. 618-639, Jun. 2004.
J.-M. Jot, V. Larcher und 0. Warusfel , "Digital signal processing issues in the context of binaural and transaural stereophony," in AES 98th Convention, Paris, Frankreich, Feb. 1995.
H. Gamper, "Head-related transfer function interpolation in azimuth, elevation and distance," J. Acoust. Soc. Am., Bd. 134, Nr. 6, EL547-EL553, Dec. 2013.
V. Algazi, R. Duda, D. Thompson , et al., "The CIPIC HRTF database," in Proc. IEEE Workshop Applications Signal Processing to Audio and Acoustics, New Paltz, NY, Oct. 2001, S. 99-102.
T. G. Stockham Jr., "High-speed convolution and correlation," in Proc. Spring Joint Computer Conf., Boston, MA, Apr. 1966, S. 229-233.
A. V. Oppenheim und R. W. Schafer, Discrete¬Time Signal Processing, 3. Auflage, Upper Saddle River, NJ: Pearson, 2010.
B. D. Kulp, "Digital equalization using Fourier transform techniques," in AES 85th Convention, Los Angeles, CA, Nov. 1988.
F. Wefers und M. Vorländer, "Optimal filter partitions for real-time FIR filtering using uniformly partitioned FFT-based convolution in the frequency-domain," in Proc. 14. Int. Conf. Digital Audio Effects, Paris, Frankreich, Sep. 2011, S. 155-161.
W. G. Gardner, "Efficient convolution without input-output delay," J. Audio Eng. Soc., Bd. 43, Nr. 3, S. 127-136, Mar. 1995.
G. Garcia, "Optimal filter partition for efficient convolution with short input/output delay," in 113th AES Convention, Los Angeles, CA, Oct. 2002.
C. Tsakostas und A. Floras, "Real-time spatial representation of moving sound sources," in AES 123th Convention, New York, NY, Oct. 2007.
J. 0. Smith III, Introduction to Digital Filters with Audio Applications. W3K Publishing, 2007. [Online]. Erhältlich: http://ccrma.stanford.edu/-jos/filters/.
C. Müller-Tomfelde, "Time-varying filter in non¬uniform block convolution," in Proc. COST G-6 Conf. Digital Audio Effects (DAFX-01), Limerick, Irland, Dec. 2001.
J. 0. Smith III, Mathematics of the Discrete Fourier Transform (DFT). W3K Publishing, 2007. [Online]. Erhältlich: http://ccrma.stanford.edu/-jos/mdft/mdft.html.
R. G. Lyons, Understanding Digital Signal Processing, 3rd ed. Upper Saddle River, NJ: Pearson, 2011.
M.C. Grant und S.P. Boyed, "Graph implementations for nonsmooth convex programs," in Recent Advances in Learning and Control, V. Blondel, S. Boyd, und H. Kimura, Eds., London, UK: Springer, 2008, S. 95-110.
F. Wefers und M. Vorländer. "Optimal Filter Partitions for Non-Uniformly Partitioned Convolution". In: Proc. AES 45th Int. Conf. Espoo, Finland, Mar. 2012, S. 324-332.
Tsakostas Christos et al: "Real-time Spatial Representation of Moving Sound Sources", AES Convention 123; Oct. 2007, AES, 60 East 42nd Street, Room 2520 New York 10165-2520, USA, Oct. 1, 2007 (Oct. 1, 2007); XP040508422.
Wenzel M. et al.: "Sound Lab: A real-time, software-based system for the study of spatial hearing", Internet citation, Feb. 19, 2000 (Feb. 19, 2000), XP002426646, found in the Internet: URL: http:/pddocserv/specdocs/data/handbooks/AES/Conv-Preprints/2000/PP0002/5140.pdf (found on Mar. 26, 2007).
Office Action issued in corresponding German patent application dated Feb. 25, 2015.
English translation of International Preliminary Examination Report for PCT/EP2015/055094.
Office Action issued in corresponding China patent application No. 2015800137882 dated Nov. 16, 2017 (and its English translation).
Office Action issued in corresponding Japanese patent application No. 2016-557289 dated Dec. 12, 2017 (and its English translation).

* cited by examiner (CROSSFADING)

(GAIN CHANGE WITHOUT CROSSFADING)

$K = 15, R = \{0, \ldots, 7\}, I = \{1, \ldots, 7\}$ 0,5000
-0,2936 − 0,0072i
-0,0054 + 0,1095i
0,0440 + 0,0032i
0,0015 − 0,0157i
-0,0045 − 0,0006i
-0,0001 + 0,0009i
0,0001 + 0,0000i

Fig. 7a $K = 8, R = \{0, \ldots, 7\}, I = \{\}$ 0,4930
-0,2072
0,0010
-0,0242
0,0010
-0,0096
0,0010
-0,0056

Fig. 7b $K = 8, R = \{0, 1, 3, 5, 7\}, I = \{2, 4, 6\}$ 0,4921
-0,2940
0 + 0,1100i
0,0446
0 − 0,0160i
-0,0046
0 + 0,0009i
0,0001

Fig. 7c $K = 4, R = \{0, 1, 3\}, I = \{2\}$ 0,4921
-0,2640
0 + 0,686i
0,0122

Fig. 7d $K = 3, R = \{0, 1\}, I = \{2\}$ 0,4934
-0,2494
0 + 0,0500i

Fig. 7e $K = 2, R = \{0, 1\}, I = \{\}$ 0,4997
-0,2462

Fig. 7f

| K | sets of coefficients | $L_2$ errors | $L_\infty$ errors |
|---|---|---|---|
| 15 | $R = \{0, \ldots, 7\}$, $I = \{1, \ldots, 7\}$ | $9{,}372 \cdot 10^{-6}$ | $5{,}653 \cdot 10^{-6}$ |
| 8 | $R = \{0, \ldots, 7\}$, $I = \{\}$ | $5{,}452 \cdot 10^{-2}$ | $1{,}550 \cdot 10^{-2}$ |
| 8 | $R = \{0, 1, 3, 5, 7\}$, $I = \{2, 4, 6\}$ | $9{,}388 \cdot 10^{-6}$ | $7{,}102 \cdot 10^{-6}$ |
| 4 | $R = \{0, 1, 3\}$, $I = \{2\}$ | $6{,}641 \cdot 10^{-3}$ | $2{,}611 \cdot 10^{-3}$ |
| 3 | $R = \{0, 1\}$, $I = \{2\}$ | $4{,}676 \cdot 10^{-2}$ | $8{,}687 \cdot 10^{-3}$ |
| 2 | $R = \{0, 1\}$, $I = \{\}$ | $5{,}403 \cdot 10^{-1}$ | $1{,}017 \cdot 10^{-1}$ |

Fig. 7g

FILTER LENGTH N

BLOCK SIZE B

NUMBER OF NON-ZERO COEFFICIENTS

NUMBER OF VIRTUAL SOURCES M

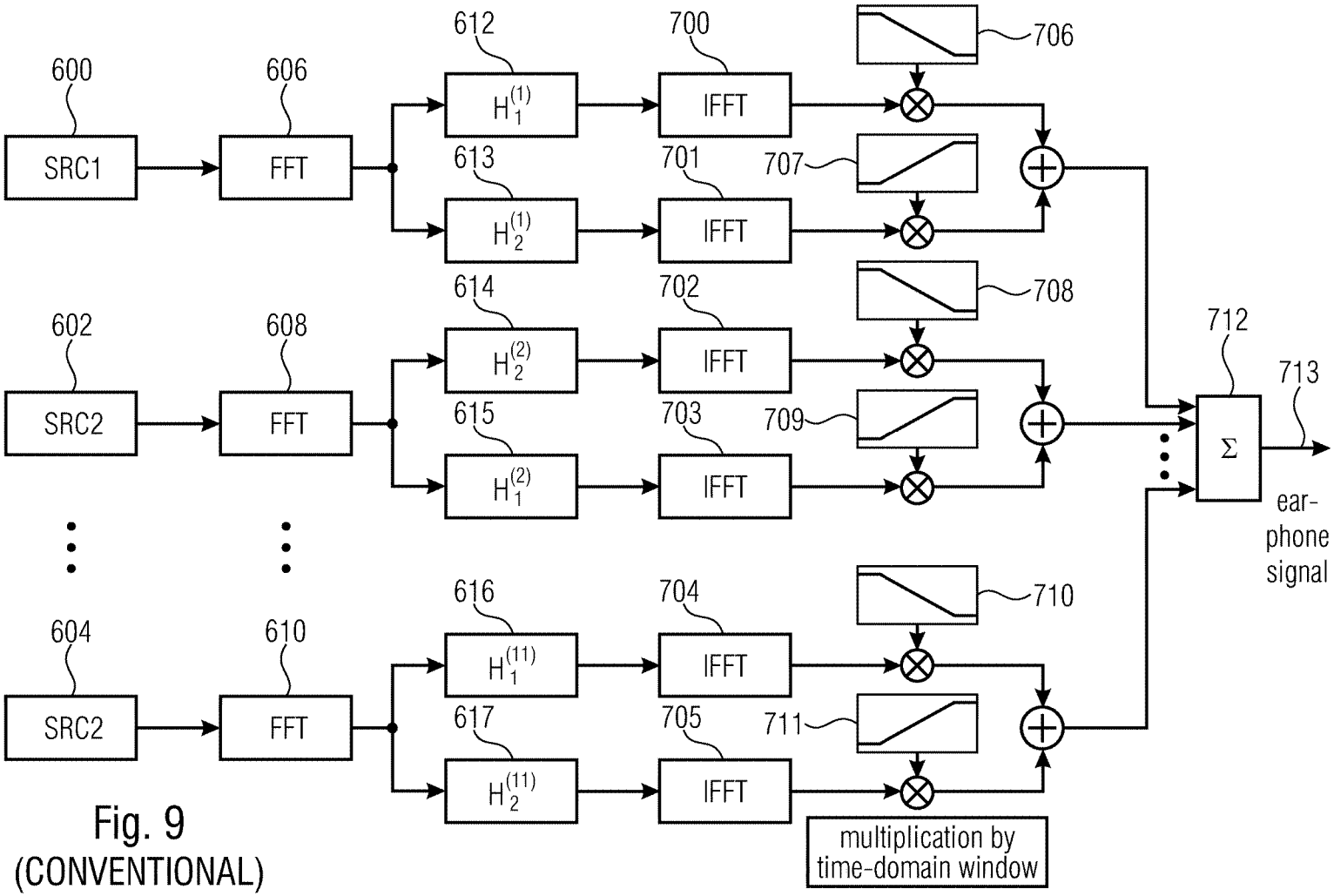
Fig. 9
(CONVENTIONAL)

(GAIN CHANGE)

DEVICE AND METHOD FOR PROCESSING A SIGNAL IN THE FREQUENCY DOMAIN

CROSS-REFERENCE TO RELATED APPLICATIONS

This application is a continuation of U.S. patent application Ser. No. 15/264,756, filed on Sep. 14, 2016, which is a continuation of copending International Application No. PCT/EP2015/055094, filed Mar. 11, 2015, which is incorporated herein by reference in its entirety, and additionally claims priority from European Application No. 14159922.5, filed Mar. 14, 2014, and from German Application No. 102014214143.5, filed Jul. 21, 2014, which are also incorporated herein by reference in their entirety.

BACKGROUND OF THE INVENTION

The present invention relates to processing signals and, in particular, audio signals in the frequency domain.

In many fields of signal processing, filter characteristics are changed at runtime. Frequently, a gradual smooth transition is necessitated here to prevent interferences by switching (for example, discontinuities in the signal path, in the case of audio signals audible click artifacts). This may be performed either by a continuous interpolation of the filter coefficients or simultaneously filtering the signal by two filters and subsequently gradually crossfading the filtered signals. Both methods provide identical results. This functionality will be referred to as "crossfading" below.

When filtering by FIR-Filters, which is also referred to as linear convolution, considerable increases in performance can be achieved by using fast convolution algorithms. These methods operate in the frequency domain and operate on a block-by-block basis. Frequency-domain convolution algorithms, such as Overlap-Add and Overlap-Save (among others [8]; [9]), partition only the input signal, but not the filter and consequently use large FFTs (Fast Fourier Transform), resulting in high latencies when filtering. Partitioned convolution algorithms, partitioned either uniformly [10]; [11] or non-uniformly [12]; [13]; [20], also divide the filters (or impulse responses thereof) into smaller segments. By applying the frequency-domain convolution to these partitions, a corresponding delay and combination of the results, a good trade-off between the FFT size used, latency and complexity can be achieved.

However, it is common to all methods of fast convolution that they are only very difficult to combine with gradual filter crossfading. On the one hand, this is due to the block-by-block mode of operation of these algorithms. On the other hand, interpolation of intermediate values between different filters, as arise in the case of a transition, would result in a considerably increased computing burden, since these interpolated filter sets each first have to be transformed to a form suitable for applying fast convolution algorithms (this usually necessitates segmentation, zero padding and an FFT Operation). For "smooth" crossfading, these operations have to be performed quite frequently, thereby considerably reducing the performance advantage of fast convolutions.

Solutions described so far may particularly be found in the field of binaural synthesis. Thus, either the filter coefficients of the FIR filters are interpolated, followed by a convolution in the time domain [5] (remark: the gradual exchange of filter coefficients in this publication is referred to as "commutation"). [14] describes crossfading between FIR filters by applying two fast convolution operations, followed by crossfading in the time domain. [16] deals with exchanging filter coefficients in non-uniformly partitioned convolution algorithms. Thus, both crossfading and exchange strategies for the partitioned impulse response blocks (aiming at gradual crossfading) are considered.

From an algorithmic point of view (however, for a different application), a method, described in [18], for post-smoothing a spectrum obtained by the FFT comes closest to the solution described here. There, applying a special time-domain window (of a cosine type, such as, for example, a Hann or Hamming window) is implemented by a convolution in the frequency domain using a frequency-domain windowing function of only 3 elements. Crossfading or fading-in or fading-out signals is not provided for there as an application; in addition, the method described there is based on fixed 3-elements frequency-domain windows which are based on windows known in DSP, and does not exhibit a flexibility in order to adjust complexity and quality of the approximation to a predetermined window function (and, consequently, nor does the design method for the sparsely occupied window functions). On the other hand, [18] does neither consider using the overlap-safe method, nor the possibility of not having to determine defaults for certain parts of the time-domain window function.

Binaural synthesis allows a realistic reproduction of complex acoustic scenes via headphones which is applied to many fields, such as, for example, immersive communication [1], auditory displays [2], virtual reality [3] or augmented reality [4]. Rendering dynamic acoustic scenes, in that dynamic head movements of the listeners are also considered, improves the localizing quality, realism and plausibility of binaural synthesis considerably, but also increases the computing complexity as regards rendering. A different, usually applied way of improving the localizing precision and naturalness is adding spatial reflections and reverberation effects, for example [1], [5], for example by calculating a number of discrete reflections for each sound object and rendering these as additional sound objects. Again, such techniques increase the complexity of binaural rendering considerably. This emphasizes the importance of efficient signal processing techniques for binaural synthesis.

The general signal flow of a dynamic binaural synthesis system is shown in FIG. 4. The signals of the sound objects are filtered by the head-related transfer functions (HRTFs) of both ears. A summation of these contributions provides the signal of the left and right ears which are reproduced by headphones. HRTFs map sound propagation from the source position to the ear drum and vary in dependence on the relative position—depending on the azimuth, elevation and, within certain limits, also on the distance [6]. Thus, dynamic sound scenes necessitate filtering using temporally varying HRTFs. Generally, two techniques which are mutually related, but separate, are necessitated in order to implement such temporally varying filters: HRTF interpolation and filter crossfading. In this context, interpolation refers to determining HRTFs for a certain source position which is usually indicated by azimuth and elevation coordinates. Since HRTFs are usually provided in databases of a finite spatial resolution, for example [7], this includes selecting a suitable sub-set of HRTFs and interpolation between these filters [3], [6]. Filter crossfading, which in [5] is referred to as "commutation", allows a smooth transition, distributed over a certain transition time, between these, potentially interpolated, HRTFs. Such gradual transitions are necessitated in order to avoid audible signal discontinuities, such as, for example, click noises. The present document focuses on the crossfading process.

Due to the conventionally large number of sound objects, filtering the source signals by the HRTFs contributes considerably to the complexity of binaural synthesis. A suitable way of decreasing this complexity is applying frequency-domain (FD) convolution techniques, such as Overlap-Add or Overlap-Save methods [8], [9], or partitioned convolution algorithms, for example [10] to [13]. A common disadvantage of all the FD convolution methods is that an exchange of filter coefficients or a gradual transition between filters is restricted more strongly and usually necessitates a higher computing complexity than crossfading between time-domain filters. On the one hand, this may be attributed to the block-based mode of operation of these methods. On the other hand, the requirement of transferring the filters to a frequency-domain representation entails a considerable reduction in performance with frequent filter changes. Consequently, a typical solution for filter crossfading includes two FD convolution processes using different filters and subsequently crossfading the outputs in the time domain.

SUMMARY

According to an embodiment, a device for processing a discrete-time signal may have: a processor stage configured to: filter the signal which is present in a discrete frequency-domain representation by a filter with a filter characteristic by means of a multiplication by a transfer function in order to obtain a filtered signal, provide the filtered signal with a frequency-domain window function in order to obtain a windowed signal, wherein providing has multiplications of frequency-domain window coefficients of the frequency-domain window function by spectral values of the filtered signal in order to obtain multiplication results, and summing up the multiplication results; and a converter for converting the windowed signal or a signal determined using the windowed signal to a time domain in order to obtain the processed signal.

According to another embodiment, a method for processing a signal may have the steps of: filtering the signal which is present in a frequency-domain representation by a filter with a filter characteristic by means of a multiplication by a transfer function in order to obtain a filtered signal; providing the filtered signal with a frequency-domain window function in order to obtain a windowed signal, wherein providing has multiplications of frequency-domain window coefficients of the frequency-domain window function by spectral values of the filtered signal in order to obtain multiplication results, and summing up the multiplication results; and converting the windowed signal or a signal determined using the windowed signal to a time domain in order to obtain the processed signal.

According to still another embodiment, a device for processing a discrete-time signal may have: a processor stage configured to: filter the signal which is present in a discrete frequency-domain representation by a filter with a filter characteristic in order to obtain a filtered signal, provide the filtered signal or a signal derived from the filtered signal with a frequency-domain window function in order to obtain a windowed signal, wherein providing has multiplications of frequency-domain window coefficients of the frequency-domain window function by spectral values of the filtered signal or the signal derived from the filtered signal in order to obtain multiplication results, and summing up the multiplication results; and a converter for converting the windowed signal or a signal determined using the windowed signal to a time domain in order to obtain the processed signal, wherein the processor stage is further configured to filter the signal which is present in the frequency domain by a further filter with a further filter characteristic in order to obtain a further filtered signal, to provide the further filtered signal with a further frequency-domain window function in order to obtain a further windowed signal, and to combine the windowed signal and the further windowed signal, or wherein the processor stage is further configured to filter the signal which is present in a frequency-domain representation, using a further filter with a further filter characteristic in order to form a combination signal from the filtered signal and the further filtered signal, to provide the combination signal with the frequency-domain window function in order to obtain a windowed combination signal, and to combine the windowed combination signal with the filtered signal and the further filtered signal, or wherein the frequency-domain window function has a temporally increasing or temporally decreasing gain characteristic, and wherein the processor stage is further configured to combine the windowed signal and the filtered signal by means of a combiner, the combiner having: a first multiplier for multiplying the windowed signal by a first value; a second multiplier for multiplying the filtered signal by a second value; and a summer for summing up the multiplier output signals.

According to another embodiment, a method for processing a signal may have the steps of: filtering the signal which is present in a discrete frequency-domain representation by a filter with a filter characteristic in order to obtain a filtered signal, provide the filtered signal or a signal derived from the filtered signal with a frequency-domain window function in order to obtain a windowed signal, wherein providing has multiplications of frequency-domain window coefficients of the frequency-domain window function by spectral values of the filtered signal or the signal derived from the filtered signal in order to obtain multiplication results, and summing up the multiplication results; and converting the windowed signal or a signal determined using the windowed signal to a time domain in order to obtain the processed signal, wherein the method has the steps of: filtering the signal which is present in the frequency domain by a further filter with a further filter characteristic in order to obtain a further filtered signal, providing the further filtered signal with a further frequency-domain window function in order to obtain a further windowed signal, and combining the windowed signal and the further windowed signal, or wherein the method further has the steps of: filtering the signal which is present in a frequency-domain representation, using a further filter with a further filter characteristic, forming a combination signal from the filtered signal and the further filtered signal, providing the combination signal with the frequency-domain window function in order to obtain a windowed combination signal, and combining the windowed combination signal with the filtered signal and the further filtered signal, or wherein the frequency-domain window function has a temporally increasing or temporally decreasing gain characteristic, and wherein the method further has the steps of: combining the windowed signal and the filtered signal by means of a combiner, the combiner having: a first multiplier for multiplying the windowed signal by a first value; a second multiplier for multiplying the filtered signal by a second value; and a summer for summing up the multiplier output signals.

Another embodiment may have a non-transitory digital storage medium having stored thereon a computer program for executing a method for processing a signal, having the steps of: filtering the signal which is present in a frequency-domain representation by a filter with a filter characteristic by means of a multiplication by a transfer function in order to obtain a filtered signal; providing the filtered signal with a frequency-domain window function in order to obtain a windowed signal, wherein providing has multiplications of frequency-domain window coefficients of the frequency-domain window function by spectral values of the filtered signal in order to obtain multiplication results, and summing up the multiplication results; and converting the windowed signal or a signal determined using the windowed signal to a time domain in order to obtain the processed signal, when said computer program is run by a computer.

Still another embodiment may have a non-transitory digital storage medium having stored thereon a computer program for executing a method for processing a signal, having the steps of: filtering the signal which is present in a discrete frequency-domain representation by a filter with a filter characteristic in order to obtain a filtered signal, provide the filtered signal or a signal derived from the filtered signal with a frequency-domain window function in order to obtain a windowed signal, wherein providing has multiplications of frequency-domain window coefficients of the frequency-domain window function by spectral values of the filtered signal or the signal derived from the filtered signal in order to obtain multiplication results, and summing up the multiplication results; and converting the windowed signal or a signal determined using the windowed signal to a time domain in order to obtain the processed signal, wherein the method has the steps of: filtering the signal which is present in the frequency domain by a further filter with a further filter characteristic in order to obtain a further filtered signal, providing the further filtered signal with a further frequency-domain window function in order to obtain a further windowed signal, and combining the windowed signal and the further windowed signal, or wherein the method further has the steps of: filtering the signal which is present in a frequency-domain representation, using a further filter with a further filter characteristic, forming a combination signal from the filtered signal and the further filtered signal, providing the combination signal with the frequency-domain window function in order to obtain a windowed combination signal, and combining the windowed combination signal with the filtered signal and the further filtered signal, or wherein the frequency-domain window function has a temporally increasing or temporally decreasing gain characteristic, and wherein the method further has the steps of: combining the windowed signal and the filtered signal by means of a combiner, the combiner having: a first multiplier for multiplying the windowed signal by a first value; a second multiplier for multiplying the filtered signal by a second value; and a summer for summing up the multiplier output signals, when said computer program is run by a computer.

The present invention is based on the finding that, in particular when processing in the frequency domain is done anyway, windowing which actually is to take place in the time domain, that is multiplying, element by element, by a time-domain sequence, such as, for example, crossfading, gaining, or any other processing of a signal, is performed also in this frequency-domain representation. Thus, it is to be kept in mind that such windowing in the time domain is to be performed in the frequency domain as a convolution and, for example, as a circular convolution. This is of particular advantage in connection with partitioned convolution algorithms which are performed to replace a convolution in the time domain by a multiplication in the frequency domain. In such algorithms and other applications, the time-to-frequency transform algorithms and the inverse frequency-to-time domain transform algorithms are so complicated that a convolution in the frequency domain using a frequency-domain windowing function justifies the complexity. In particular, in multi-channel applications where otherwise many frequency-to-time transforms would be necessitated in order to subsequently achieve time-domain windowing, for example crossfading or gain change, it is, in accordance with the invention, of great advantage to rather perform signal processing which is actually provided for in the time domain, in the frequency domain, that is that domain having been selected anyway by a partitioned convolution algorithm. The circular (also cyclic or periodic) convolution in the frequency domain necessitated by this is not problematic in terms of complexity when applying suitable frequency-domain windowing functions, since a number of frequency-to-time domain transform algorithms can be saved here.

A plurality of necessitated time-domain windowing functions are very easy to approximate by such window functions, the frequency-domain representation of which comprises only a few non-zero coefficients. This means that the circular convolution may be performed so efficiently that the gain by saving the additional frequency-to-time domain transforms exceeds the costs of the circular convolution in the frequency domain. In embodiments of the present invention which deal with fading-in, fading-out, crossfading or changing the volume, a considerable reduction in complexity may be achieved particularly by solely approximating a time-domain window function in the frequency domain, that is by restricting the number of coefficients to, for example, less than 18 coefficients in the frequency domain. Additional gains in efficiency may be achieved by efficient computing rules for the circular convolution by making use of the structure of the frequency-domain window function. On the one hand, this applies to the conjugate-symmetrical structure of this window function which results from the real-valuedness of the respective-time domain window function. On the other hand, summands of the circular convolution sum may be calculated more efficiently when the respective coefficients of the frequency-domain window function are of purely real value or purely imaginary.

In particular with constant-gain crossfading, that is when the sum of the fading-in and fading-out functions at each point in time is 1, the complexity of the circular convolution may be reduced even further since only a single convolution using a frequency-domain filter function has to be calculated and, otherwise, only the difference between two filtered signals has to be formed.

In embodiments, a single signal may be filtered by only a single filter to then apply a frequency-domain window function in order to achieve, for example, a change in the volume or gain of the signal already in the frequency domain.

In an alternative embodiment in which constant-gain crossfading, that is crossfading of constant gain, is aimed at, it is of advantage, at first, to calculate a difference between two filter output signals which have been generated by filtering one and the same input signal by two different filters in order to then subject the difference signal to a frequency-domain window function.

In still another embodiment of the present invention, each filter output signal with a special frequency-domain window is convoluted circularly, and the convolution output signals are then added up in order to obtain the result of the exemplary crossfading in the frequency domain. When two separate frequency-domain windows are used, the filter input signals may also differ. Alternatively, this case also relates to extending an example of application with only one signal and, for example, a gain change function which is extended to many parallel channels, and where the combination of the signals in the frequency domain takes place with a single re-transform.

In particularly advantageous embodiments of the present invention, the necessitated time-domain window functions for each frequency-domain representation are only approximated. This is made use of in order to reduce the number of the frequency-domain window function coefficients to, for example, at most 18 coefficients or, in the extreme case, to only 2 coefficients. Thus, in a re-transform of these frequency-domain window functions to the time-domain, the result is a deviation from the actually necessitated window function. However, it has been found that, in particular in applications of crossfading, volume changing, fading-out, fading-in or other signal processing, this deviation is not problematic or does not or only slightly interfere in this subjective hearing impression, so that this problem, if present at all, for the subjective hearing impression may well be accepted considering the significant increases in efficiency obtained.

BRIEF DESCRIPTION OF THE DRAWINGS

Embodiments of the present invention will be detailed subsequently referring to the appendant drawings, in which:

FIGS. 7*a*-7*f* show charts of the numerical values of the frequency-domain filter coefficients for the windows shown in FIGS. 6*a* to 6*f;*

FIG. 7*g* shows a chart of the design errors for different frequency-domain window functions due to approximation;

FIG. 9 shows a diagram, similar to FIG. 4, for implementing conventional earphone signal processing;

DETAILED DESCRIPTION OF THE INVENTION

Figure 1:
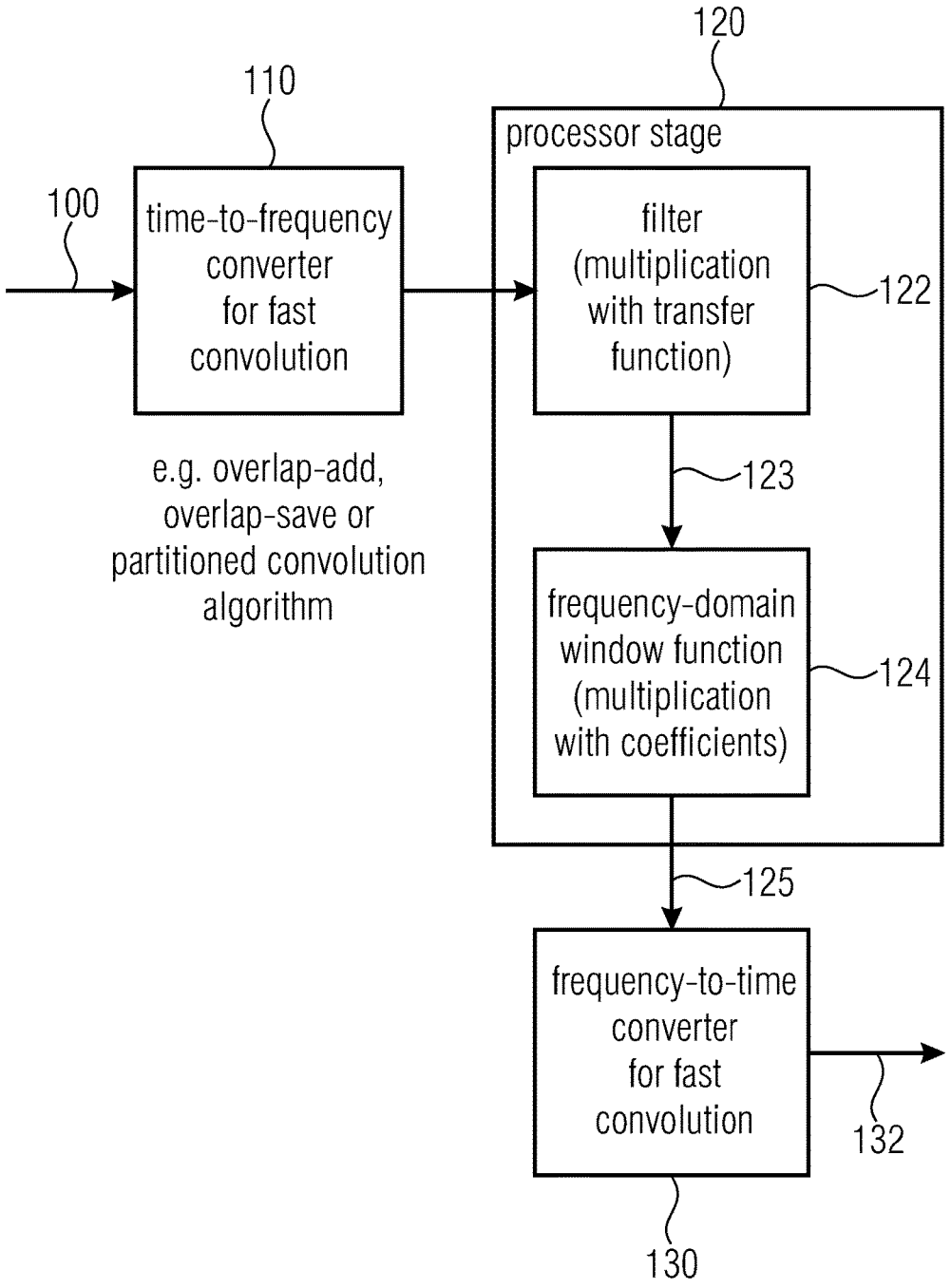
FIG. 1 shows a device for processing a signal in the frequency domain by a frequency-domain window function and a filter.

FIG. 1 shows a device for processing a discrete-time signal in the frequency domain. An input signal 100 which is present in the time domain is fed to a time-to-frequency converter 110. The output signal of the time-to-frequency converter 110 is then fed to a processor stage 120 which comprises a filter 122 and frequency-domain window function providing means 124. The output signal 123 of the frequency-domain window function providing means 124 may then be fed, either directly or after processing, such as, for example, a combination with other correspondingly, equally processed signals, to frequency-time transform means or frequency-time converter 130. In an embodiment of the present invention, the time-to-frequency converter 110 and the frequency-time converter 130 are designed for fast convolution. A fast convolution may, for example, be an overlap-add convolution algorithm, an overlap-save convolution algorithm or any partitioned convolution algorithm. Such a partitioned convolution algorithm is used when direct application of an unpartitioned frequency-domain convolution algorithm, such as overlap-save or overlap-add, cannot be justified due to the latency caused by these algorithms or other practical reasons, such as the size of the FFTs used. Then, a corresponding partitioning is performed, in dependence on the corresponding convolution algorithm. A corresponding filtering, as is illustrated in block 122, may then be performed by multiplications and summation of a transformed input signal with a partition frequency-domain representation of the impulse response such that a linear convolution in the time domain can be avoided.

It is to be pointed out that the frequency-domain representation is based on a block-by-block partitioning of the signal. This implicitly results also from the character of the frequency-domain representation, which is discrete in the time and frequency domains.

As has already been illustrated, prominent examples of partitioned convolution algorithms are the overlap-add method in which an input signal is at first partitioned into non-overlapping sequences and supplemented by a certain number of zeroes. Then, discrete Fourier transforms of the individual non-overlapping zero-padded sequences and filters are formed. Then, multiplication of the transformed non-overlapping sequences by the Fourier transform of the impulse response of the filter, also supplemented by a certain number of zero samples, is performed. Subsequently, the sequences are brought back to the time domain by an inverse FFT, the resulting output signal being reconstructed by overlapping and adding. Zero-padding is necessitated in order to implement a linear convolution in the time domain using a frequency-domain multiplication which corresponds to a circular convolution in the time domain. The overlap results from the fact that the result of a linear convolution will be longer than the original sequences and that the result of each frequency-domain multiplication thus has an effect on more than one partition of the output signal.

In an alternative method, namely the overlap-save method (for example [9]), overlapping segments of the input signal are formed and transformed to the frequency domain by means of a discrete Fourier transform, such as, for example, the FFT. These sequences are multiplied, element by element, by the impulse response of the filter filled up with a number of zero samples and transformed to the frequency domain. The result of this multiplication is retransformed to the time domain by means of an inverse discrete Fourier transform. In order to avoid circular convolution effects, a fixed number of samples is discarded from each retransformed block. The output signal is formed by joining the remaining sequences.

Referring to FIG. 1, the processor stage 120 is thus configured to filter the signal which is present in the frequency-domain representation, by a filter with a filter characteristic in order to obtain a filtered signal 123.

The filtered signal or the signal derived from the filtered signal is then provided 124 with a frequency-domain window function in order to obtain a windowed signal 125, wherein providing comprises multiplication of frequency-domain window function coefficients of the frequency-domain window function by the spectral values of the filtered signal in order to obtain multiplication results, and summing up the multiplication results, that is an operation in the frequency domain. Advantageously, providing includes a circular (periodic) convolution of the frequency-domain window function coefficients of the frequency-domain window function with spectral values of the filtered signal. The converter 130, in turn, is configured to convert the windowed signal or a signal determined using the windowed signal to a time domain in order to obtain the processed signal, for example at 132.

Processing in order to obtain the signal derived from the filtered signal is to apply to all possible modifications of the signal, among others: summation, difference calculation or forming a linear combination. An example is given in the signal flow represented specifically in FIG. 3 where the "signal derived from the filtered signal" consists of the difference of two filtered signals.

Figure 2:
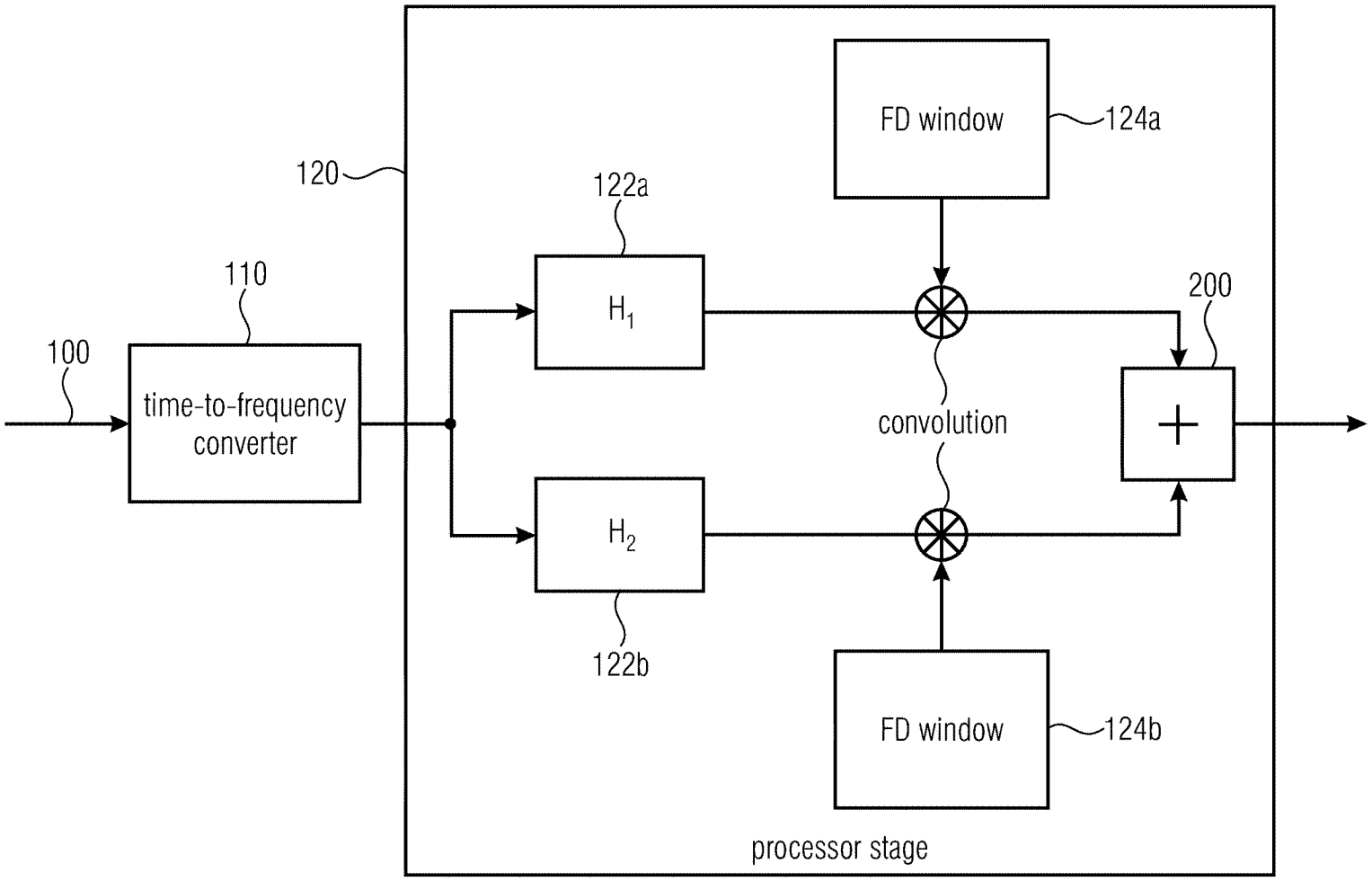
FIG. 2 shows a device for processing a signal in the frequency domain by two filters and two frequency-domain window functions.

FIG. 2 shows an alternative implementation of the processor stage where the time-to-frequency converter 110 may be implemented as in FIG. 1. In particular, the processor stage 120 comprises a filter 122*a* to filter a frequency-domain signal derived from the time-domain signal 100, with a first filter characteristic $H_1$ in order to obtain a filtered signal at the output of block 122*a*. Additionally, the processor stage is configured to filter the frequency-domain signal at the output of block 110 by a second filter 122*b* with a second filter characteristic $H_2$ in order to obtain a filtered second signal. In addition, the processor stage is configured to provide the first filtered signal with a first frequency-domain window function 124*a* in order to obtain a windowed first signal, and the processor stage is configured to provide the second filtered signal with a second frequency-domain window function 124*b* in order to obtain a windowed second signal. The two windowed signals are then combined in a combiner 200. The combined frequency-domain signal applying at the output of the combiner 200 may then, as is, for example, illustrated in FIG. 1, be converted to a time-domain signal by a converter 130.

Figure 3:
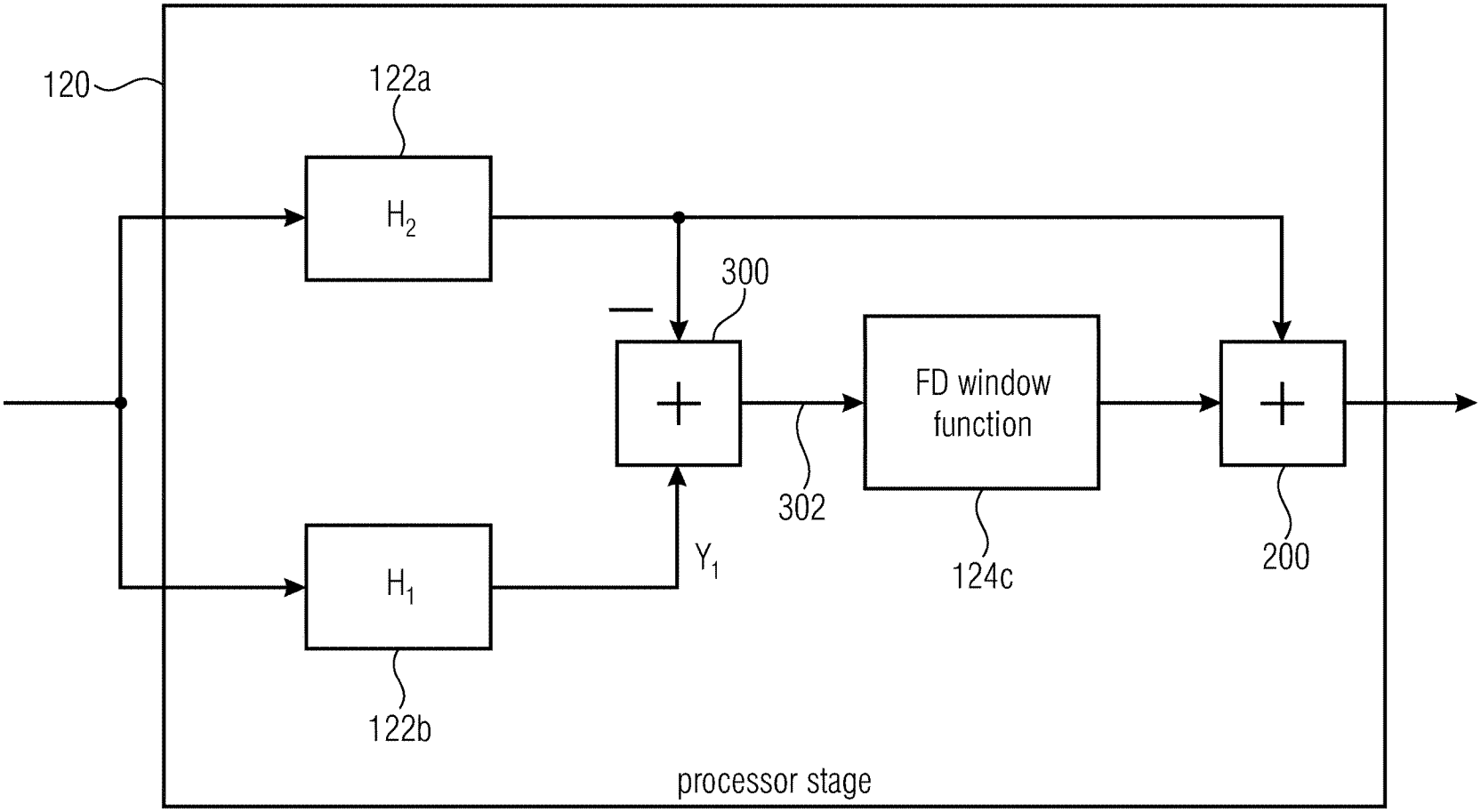
FIG. 3 shows a device for processing a signal in the frequency domain by two filters and a single frequency-domain window function.

FIG. 3 shows another implementation of the processor stage where the frequency-domain signal 105 which is derived from the time-domain signal 100 is filtered by a filter 120*a* with a first filter characteristic $H_2$ in order to obtain a first filtered signal. Additionally, the frequency-domain signal 105 is filtered by a filter 122*b* with a second filter characteristic $H_2$ in order to obtain a second filtered signal. A difference signal 302 is formed from the first and second filtered signals by a combiner 300, which is then fed to a single frequency-domain window function providing means 122*c*, wherein the providing is advantageously implemented as a circular convolution of the spectral coefficients of the difference signal with the coefficients of the frequency-domain window function. The windowed output signal is then combined with the first filtered signal at the output of block 122*a* in the combiner 200. Thus, the result at the output of combiner 200 of FIG. 3 is the same signal as at the output of the combiner 200 of FIG. 2 when the two frequency-domain window functions are constant-gain crossfading functions, that is when the time-domain representations of the frequency-domain window functions 124*a* and 124*b* supplement each other such that the sum thereof forms 1 at any time. This condition is, for example, fulfilled when the frequency-domain window function 124*a*, in the time domain, corresponds to a decreasing slope and the frequency-domain window function 124*b*, in the time domain, represents an increasing slope (or vice-versa) as is, for example, illustrated in FIG. 5*a*.

Figure 11:
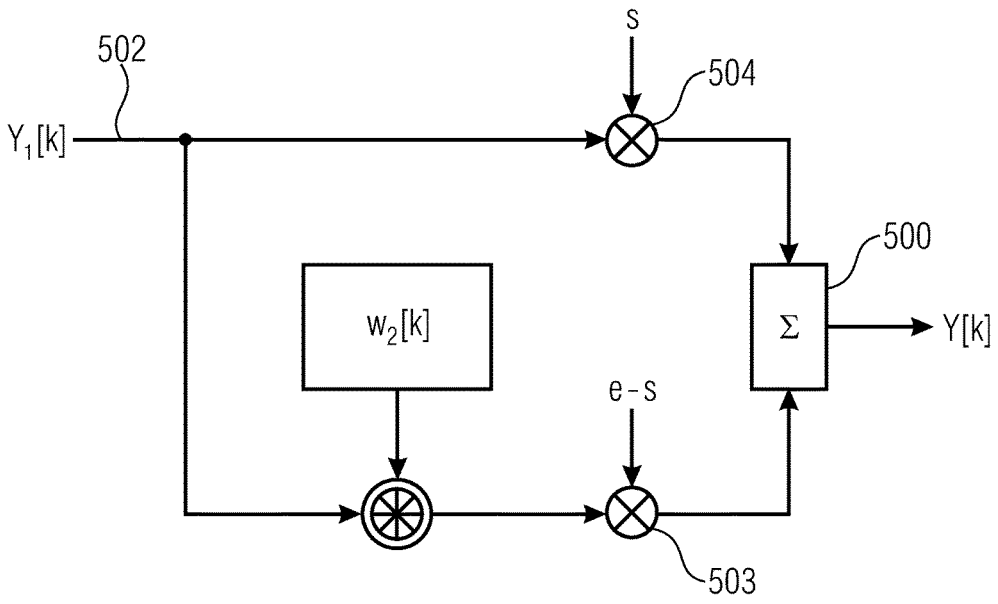
FIG. 11 shows a device for providing a signal in the frequency domain with a gain change function.

For a constant-gain crossfade with any start and final values and using a "standard window", it is of advantage to scale the signals, before the summation (300), by linear factors (s or (e−s)), as is illustrated in FIG. 11. The result is an optional scaling before the summation so that the combiner performs a linear combination as an alternative to a simple addition. Further embodiments may also be implemented.

In addition, it is pointed out that fading-in or fading-out or crossfading may take place across one or several blocks, depending on the requirements in the special implementation.

In embodiments of the present invention, the time-domain signal is an audio signal, such as, for example, the signal of a source, which may be transmitted to a loud speaker or earphone after various processing. Alternatively, the audio signal may also be the receive signal of a microphone array, for example. In still further embodiments, the signal is not an audio signal but an information signal, as is obtained after demodulation to the base band or intermediate-frequency band, namely in the context of a transmission distance, as is used for wireless communication or for optical communication. The present invention is thus useful and of advantage in all fields where temporally varying filters are used and where convolutions with such filters are performed in the frequency domain.

In an embodiment of the present invention, the frequency-domain window functions are configured such that they only approximate desired time-domain window functions. However, it has been found that a certain approximation as regards the subjective impression may easily be tolerated and results in considerable savings in computing complexity. In particular, it is of advantage for the number of window coefficients to be smaller than or equal to 18 and, more advantageously, smaller than or equal to 15 and, still more advantageously, smaller than or equal to 8, or even smaller than or equal to 4, or even smaller than or equal to 3, or, in the extreme case, even equal to 2. However, a minimum number of 2 frequency-domain window coefficients are used.

In one implementation, the processor stage is configured such that the non-zero coefficients of the frequency-domain window are partly or completely selected such that they are either purely real or purely imaginary. In addition, the frequency-domain window function providing function is configured such that it uses the purely real or purely imaginary characteristic of the individual non-zero frequency-domain window coefficients when calculating the circular convolution sum in order to achieve a more efficient evaluation of the convolution sum.

In one implementation, the processor stage is configured to use a maximum number of non-zero frequency-domain window coefficients, wherein a frequency-domain window coefficient for a minimum frequency or for the lowest bin is real. Additionally, the frequency-domain window coefficients for even bins or indices are purely imaginary and frequency-domain window coefficients for odd indices or odd bins are purely real.

Figure 10:
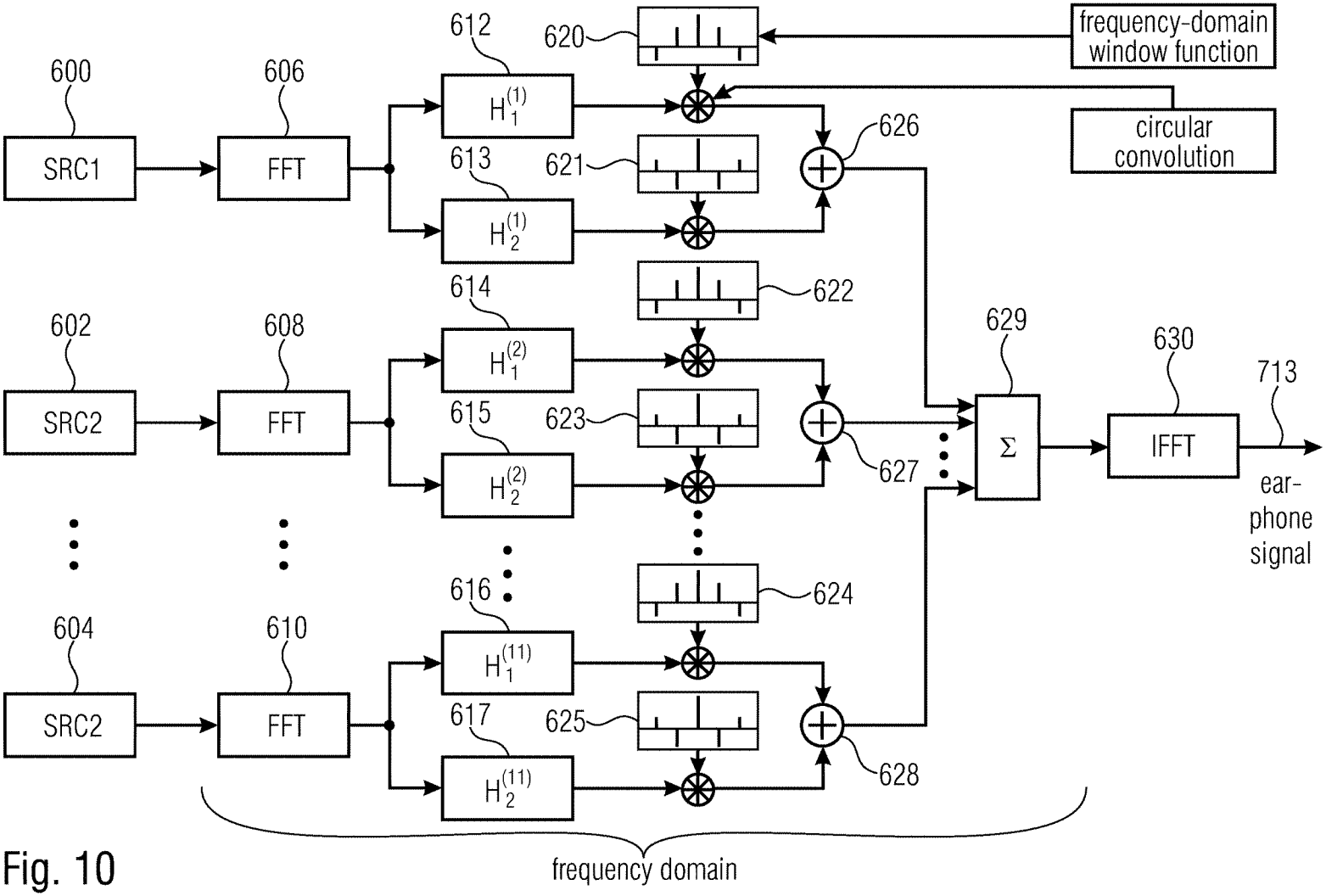
FIG. 10 shows earphone signal processing in accordance with an embodiment.

In an implementation of the present invention, as is described referring to FIG. 9, and in particular, FIG. 10, the first filter characteristic and the second filter characteristic between which crossfading is to take place, are head-related transfer functions (HRTFs) for different positions and the time-domain signal is an audio signal for a source at a correspondingly different position.

Figure 4:
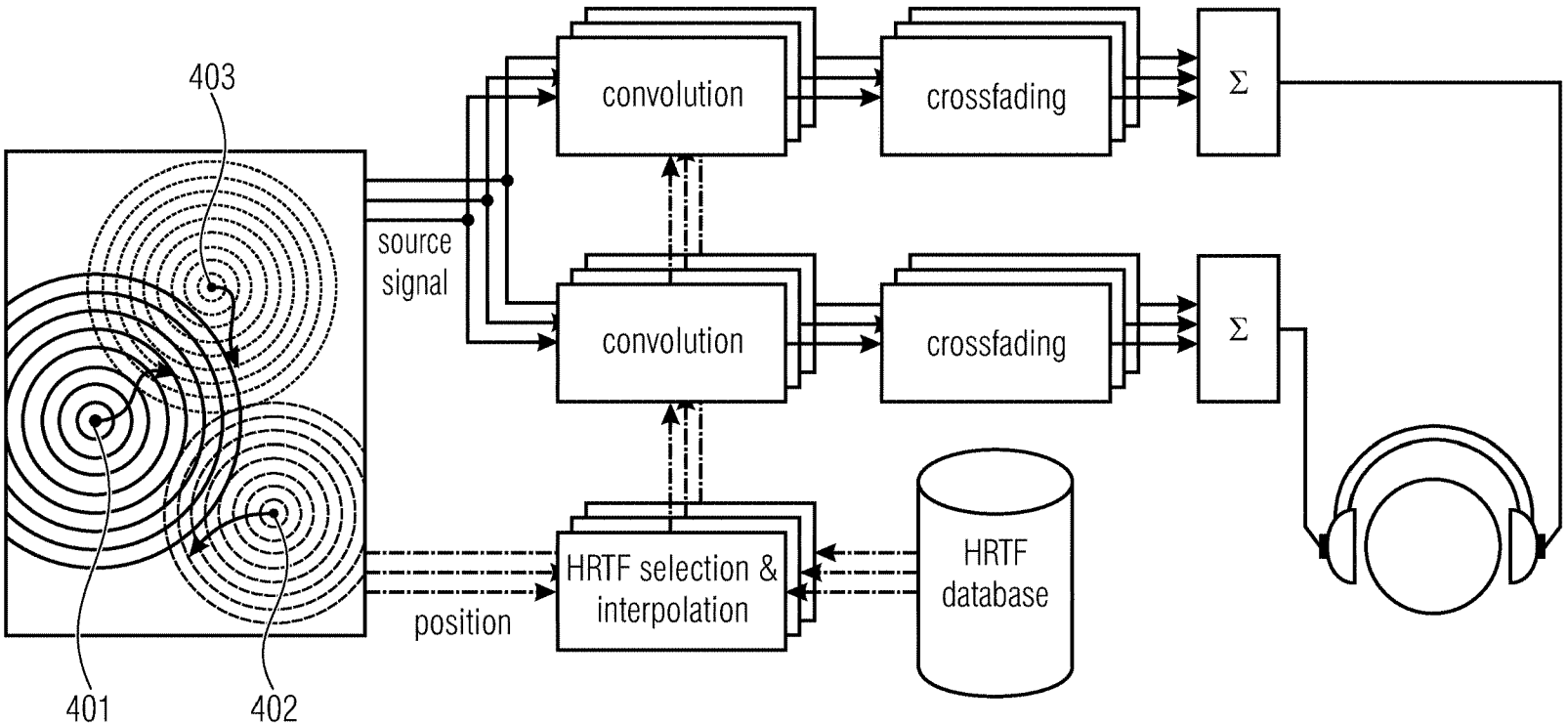
FIG. 4 shows a signal flow of a dynamic binaural synthesis system.

Additionally, it is of advantage, as is illustrated in FIG. 10, to use a multi-channel processing scenario in which several source signals in the frequency domain are crossfaded and the crossfaded signals are then added up in the frequency domain in order to only then re-transform the final sum signal to the time domain by a single transform. Here, reference is made to FIG. 9 and, for comparative purposes, FIG. 10. In particular, the different sources SRC1 to SRCM, indicated by 600, 602 and 604, represent individual audio sources, as are illustrated in FIG. 4 at 401, 402 and 403. The source signals are transformed to the frequency domain by time-to-frequency converters 606, 608 and 610 which are of an analog set-up in FIG. 9 and FIG. 10. FIG. 10 also contains the crossfading algorithm in accordance with FIG. 2 (two circular convolutions). It is also conceivable here to use the improved constant-gain crossfade of FIG. 3.

As has been discussed before, the sources 401 to 403 move and, in order to obtain, for example, the earphone signal 713, the head-related transfer function necessitated for this current source position changes for each source due to the movement of the source. As is shown in FIG. 4, there is a database which is addressed by a certain source position. Then, an HRTF is obtained for this source position from the database or, when there is no HRTF precisely for this position, two HRTFs are obtained for 2 neighboring positions, which are then interpolated. In order to achieve an operation free from artifacts, the audio signal, after the time-to-frequency conversion 606, is filtered by the first filter function by multiplication in the frequency domain which has been determined for the first position at a first time. Additionally, the same audio signal is filtered by a second filter (again by multiplication by the transfer function of the filter), wherein this second filter 613, in turn, has been determined for the second position at a later, second time. In order to obtain a transition free from artifacts, crossfading has to take place, that is the output signal of the first signal 612 is faded-out continuously and, at the same time, the output signal of the second filter 613 is faded-in, as is shown by the time filter functions 706, 707. Thus, the signals at the output of the filters 612, 613 are transformed to the time domain, as is illustrated by the IFFT blocks 700, 701 and then crossfading is performed, wherein the signals at the output of windowing are added up. This adding-up takes place per source and the corresponding crossfaded signals of all the sources are then added up in an adder 712 in the time domain in order to finally obtain the earphone signal 713.

Analog processing takes place for the other sources, as is illustrated by blocks 614, 615, 702, 703, 708, 709 and 616, 617, 704, 705, 710, 711.

Inventively, instead of the 2M IFFT blocks 700 to 705 of FIG. 9, now only a single IFFT block or a single IFFT operation 630 is performed. Fading-in/-out or crossfading with the frequency-domain window function 620, 621 or 622, 623 or 624, 625 is performed in the frequency domain as a convolution. The results of the convolutions are then each added up by the adders 626, 627, 628 and 629, wherein all the additions, however, may also be performed directly without cascading the adders 626, 627, 628 on the one hand and the adder 629 on the other hand.

This means that 2M-1 IFFT operations are saved. On the other hand, there is a potentially somewhat increased complexity of the circular convolution in the frequency-domain which, however, may be reduced considerably by an efficient window approximation, as has already been mentioned and will be discussed in greater detail below.

The present invention, in embodiments, relates to a novel method for performing crossfading, that is, a smooth gradual transition between two filtered signals, directly in the frequency domain. It operates using overlap-save algorithms and algorithms for a partitioned convolution. In case it is applied separately to each HRTF filter process, it saves one inverse FFT process per block of output samples, resulting in considerable reductions in complexity. However, a much stronger acceleration is possible if the suggested FD crossfading method is combined with restructuring the signal flow of the binaural synthesis system. When performing the summation of component signals in the frequency-domain, only a single inverse FFT is necessitated for each output signal (ear signal).

The following section provides (and defines) an overview of the naming of two techniques which are essential for the FD crossfading algorithm suggested—the fast frequency-domain convolution and time-domain crossfading.

Fast Convolution Techniques

Convolution techniques which rely on a fast transform use the equivalence between a multiplication in the frequency domain and a circular convolution in the time domain, and the availability of Fast Fourier Transform (FFT) algorithms for implementing the Discrete Fourier Transform (DFT). Overlap-add or overlap-save algorithms [8], [9] divide the input signal into blocks and transfer the frequency-domain multiplication to a linear time-domain convolution. However, in order to be efficient, overlap-add and overlap-save necessitate large FFT sizes and entail long processing latency times.

Partitioned convolution algorithms reduce these disadvantages and allow a compromise between computing complexity, FFT size used and latency time. For this purpose, the impulse response h[n] is partitioned into blocks of either uniform [10], [11] or non-uniform size [12], [13], and an FD convolution (usually overlap-save) is applied to each partitioning. The results are delayed and added correspondingly in order to form the filtered output. Reusing transform operations and data structures as frequency-domain delay lines (FDLs) [11], [13] allows efficient implementations of a linear convolution.

With impulse response lengths usually used in HRTF filters (roughly 200-1000), a uniformly partitioned convolution usually is most efficient. Thus, the present document focuses on this technique. However, applying same to a non-uniformly partitioned convolution is not complicated, since the suggested FD crossfading algorithm may be applied separately to each of the partition sizes used. The overlap-save algorithm may be considered to be an extreme case of a uniformly partitioned FD convolution of only one partition. Thus, the FD crossfading suggested is also applicable to a non-partitioned convolution.

The method of a uniformly partitioned convolution divides an impulse response h[n] of a length N into $P=\lceil N/M \rceil$ blocks of M values each ($\lceil \cdot \rceil$ represents rounding up), which padded with zeros in order to form the sequences $h_p[n]$, $p=0, \ldots, P-1$ of a length L. These are transformed to form DFT vectors H[p,k].

$$h[p,n]=[h[Mp]h[Mp+1] \ldots h[Mp+M-1] \underbrace{0 \cdots 0}] \tag{1}$$

$$H[p,k]=\mathrm{DFT}\{h[p,n]\}. \tag{2}$$

The number of zeros in equation 1 represented by the horizontal curly bracket is L-M.

The input signal x[n] is divided into overlapping blocks x[m,n] of a length L with a lead of B samples between successive blocks. A transform to the frequency domain results in the vectors X[m,k]:

$$x[m,n]=[x[mB-L+1]x[mB-L+2]\ldots x[mB]] \tag{3}$$

$$X[m,k]=\mathrm{DFT}\{x[m,n]\}. \tag{4}$$

The frequency-domain output signal Y[m,k] is formed by a block convolution of H[p,k] and X[m,k]:

$$Y[m,k]=\Sigma_{p=0}^{P-1}H[p,k]\cdot X[m-p,k], \tag{5}$$

wherein "·" represents a complex vector multiplication. An inverse DFT results in the time-domain block of a length L:

$$y[m,n]=\mathrm{DFT}^{-1}\{Y[m,k]\} \tag{6}$$

For each output block y[m,n], the last B samples are used to form the m-th block of the output signal y[n].

$$y[mB+n]=y[m,L-B+n]n=0,\ldots,N-1. \tag{7}$$

Time-domain aliasing in the output signal is prevented if the following applies:

$$M\leq L-B+1 \tag{8}$$

[9], [11]. A typical selection for a partitioned convolution is L=2B, for example [12], [13], which subsequently will be referred to as the standard DFT size and allows a high efficiency for practical combinations of N and B [11].

For each output block of B samples, the algorithm for a uniformly partitioned convolution necessitates an FFT and an inverse FFT, P vector multiplications and P−1 vector additions. For real-valued time-domain signals, both the FFT and the IFFT necessitate approximately p L $\log_2$(L) real-valued operations. Here, p is a hardware-dependent constant, wherein typical values are between p=2.5 [12] and p=3 [13]. Since the vectors X[m,k], H [p,k] and Y[m,k] for real signals and filters are conjugate-symmetrical, they may be represented unambiguously by ⌈(L+1)/2)⌉ complex values. The number of operations for adding or multiplying conjugate-symmetrical vectors is reduced correspondingly. Since scalar complex additions and multiplications may be performed by 2 and 6 real-valued operations, respectively, evaluating the block convolution (6) necessitates ⌈(L+1)/2⌉ (6P+2(P−1)) arithmetic instructions. Thus, the overall complexity for convoluting B samples is 2pL $\log_2$ L+⌈(L+1)/2⌉6P+2(P−1).

Filter Crossfading in the Time-Domain

Convoluting audio signals with temporally varying HRTFs necessitates a smooth transition between the filter characteristics, since abrupt changes result in signal discontinuities [5], [14], which causes audible artifacts, for example clicking or zipper noise. Formally, a transition between two temporally non-varying filters FIR $h_1[n]$ and $h_2[n]$ of a length N may be expressed as a temporally varying convolution sum (for example [15]):

$$y[n]=\Sigma_{k=0}^{N-1}h[n,k]x[n-k], \tag{9}$$

wherein the temporally varying filter h[n,k] ist a summation of the two filters which are weighted by two functions $w_1[n]$ and $w_2[n]$ which subsequently are referred to as time-domain windows:

$$h[n,k]=w_1[n]h_1[n-k]+w_2[n]h_2[n-k]. \tag{10}$$

Figure 5A:
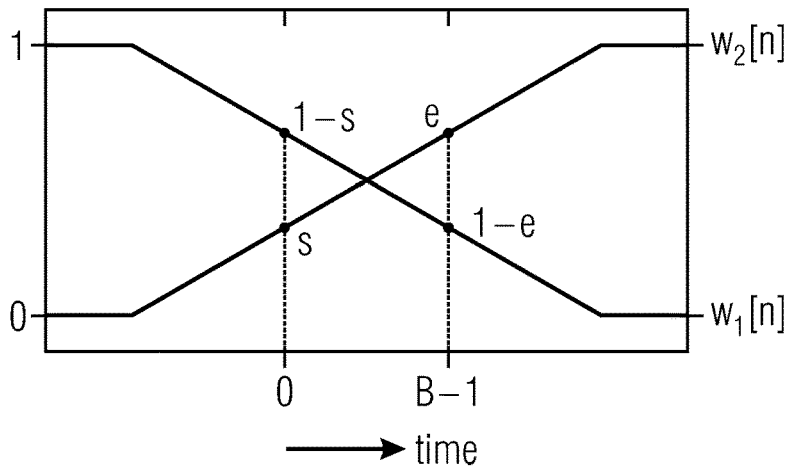
FIG. 5*a* shows a time-domain window function for linear crossfading as an example of constant-gain crossfading.

FIG. 5*a* shows an example of such window functions. If the filters $h_1[n]$ and $h_2[n]$ are strongly correlated, which is generally true for transitions between close HRTFs, constant-gain crossfading is usually employed. This means that the sum of the weights $w_1[n]$ and $w_2[n]$ for every n equals 1. In this case, these weights can be expressed by an individual window function w[n], wherein $w_1$ [n]=w[n], $w_2[n]=1-w[n]$ applies. Thus, h[n,k] for every n forms a linear interpolation between $h_1[n]$ and $h_2[n]$. Consequently, (10) may be evaluated by a single multiplication:

$$h[n,k]=h_2[n]+w[n](h_1[n]-h_2[n]). \tag{11}$$

Instead of convoluting a signal with interpolated, temporally varying filter coefficients, filtering the input signal with $h_1[n]$ and $h_2[n]$ which is followed by a weighted summation with the windows $w_1[n]$ and $w_2[n]$, results in the same signal as:

$$Y[n]=w_1[n]y_1[n]+w_2[n]y_2[n] \text{ with} \tag{12}$$

$$y_1[n]=\Sigma_{k=0}^{N}h_1[k]x[n-k] \text{ and } y_2[n]=\Sigma_{k=0}^{N}h_2[k]x[n-k].$$

Similarly to (11), constant-gain crossfading may be implemented as a linear interpolation:

$$y[n]=y_2[n]+w[n](y_1[n]-y_2[n]). \tag{13}$$

The implementations (11) and (13) exhibit a comparable complexity, whereas (13) is somewhat more efficient if the filter coefficients are updated very frequently, that is when smooth transitions free from artefacts are necessitated. In addition, the last mentioned form may be used if the filter coefficients h[n,k] cannot be manipulated directly, for example if a fast convolution is used. Examples combining an FD convolution and output crossfading are illustrated, for example, in [14], [16].

For a block-based operation, for example in a combination with an FD convolution method, an application of (13) may be realized easily if the length of the transition is identical to the block size B. For longer transition periods, crossfading of the filtered signals may, however, be implemented efficiently using a single window w[n] of a length B, if two conditions are met: (a) the desired transition between the filters is to correspond to a linear function (slope); (b) the full transition period $B_{full}$ is to be an integer multiple of the original block size B. In this case, the transition may be divided into $M=B_{full}/B$ blocks. Each block of the full transition may be expressed by multiplying the difference signal $y_1[n]-y_2[n]$ by an individual window function w[n] which implements a linear transition from 1 to 0 within B samples. A linear combination with $y_1[n]$ and $y_2[n]$ results in the output signal for this block:

$$y[n]=y_2[n]+(s+[e-s]w[n])(y_1[n]-y_2[n]). \tag{14}$$

Here, s=m/M and e=(m+1)/M, m=0 . . . M−1 refer to initial and final coefficients for the m-th block within a transition across M blocks.

Frequency-Domain Representation of Time-Domain Crossfading

This section describes an algorithm which operates on the basis of the frequency-domain description of a filtered signal, for example the representation of Y[m,k] (5) within a partitioned convolution algorithm in order to implement soft crossfading of the final time-domain output. The main motivation here is increased efficiency since, for output crossfading, only an inverse FFT is necessitated if the transition is implemented in the frequency domain.

To express time-domain crossfading in the frequency-domain, an element-by-element multiplication of an individual signal x[n] by a time-domain window w[n] is considered:

$$y[n]=x[n]\cdot w[n], \tag{15}$$

which may be considered to be part of output crossfading (12). The extension to complete crossfading and further optimizations of complexity will be discussed in the section "Efficient implementations for additional reductions in complexity".

The frequency-domain representation of (15) results from the duality of the convolution theorem [9], [17]:

$$DFT\{x[n]\cdot w[n]\} = \frac{1}{L}DFT\{x[n]\} \circledast DFT\{w[n]\}, \tag{16}$$

wherein $\circledast$ refers to a circular convolution of two discrete-time sequences. Thus, time-domain crossfading may be implemented by means of a circular FD convolution. From a computing point of view, such frequency-domain crossfading, however, does not appear to be attractive. In general, a circular convolution of two sequences of a length L necessitates approximately $L^2$ complex multiplications and additions, which exceeds by far the potential gain of approximately $O(L \log_2 L)$ due to the savings of an inverse FFT.

If, however, the frequency-domain window W[k] contains only a few non-zero coefficients, the FD crossfading may become more efficient than the conventional time-domain implementation. A first hint that window functions of only a few frequency-domain coefficients may be applied successfully, is given in [18] where frequency-domain sequences, consisting of three coefficients, which correspond to time-domain Hann or Hamming windows, are used for smoothing FFT spectra. Below, it is illustrated how such sparsely occupied windows for being used in time-domain crossfading operations may be shaped suitably.

Design of Frequency-Domain Windows

The design aim for a frequency-domain window W[k] is that the corresponding time-domain sequence $\mathring{w}[n]=DTFT^{-1}\{W[k]\}$ approximates a desired window function $\hat{w}[n]$ relative to a predetermined error norm. The ring-shaped accent here indicates that $\mathring{w}[n]$ is the result of an inverse FFT which may contain artefacts of a circular convolution (i.e. time-domain aliasing). Both $\mathring{w}[n]$ and $\hat{w}[n]$ exhibit the length L, whereas the time-domain window w[n], for an output block of the length B, exhibits a length B.

Due to the overlap-save mechanism which depends on the partitioned convolution method (8), when windowing the current block, only the last B values of $\mathring{w}[n]$ are really used, whereas the contribution of the other elements is discarded. Consequently, the desired time-domain window function for the FD crossfading algorithm $\hat{w}[n]$ and the window w[n] of the conventional time-domain crossfading exhibit the following relation:

$$\hat{w}[L-B+n]=w[n]\ 0\le n<B. \tag{17}$$

This means that no limitations are imposed on the first L−B coefficients of $\hat{w}[n]$, that is they may take any values without influencing the result of the frequency-domain crossfading. These degrees of freedom may be made use of advantageously when designing W[k]. The window functions W[k] and $\mathring{w}[n]$ are related to each other by the following inverse DFT:

$$\mathring{w}[n] = L\cdot DFT^{-1}\{W[k]\} = \sum_{k=0}^{L-1} W[k]e^{j\frac{2\pi}{L}nk}, \tag{18}$$

wherein the leading factor L results from the dual representation of the convolution theorem (16).

In order to crossfade real-valued signals, the time-domain windows w[n] and, thus, $\mathring{w}[n]$ are purely real. This means that the frequency-domain window is conjugated-symmetrical:

$$W[N-k]=\overline{W[k]}. \tag{19}$$

Consequently, W[k] is defined unambiguously by $\lceil (L+1)/2 \rceil$, for example W[0], . . . , $\lceil (L+1)/2 \rceil$. This also means that W[0] is purely real-valued. Also, if L is even-numbered, W[L/2] is also purely real.

By expressing W[k] by its real and imaginary components:

$$W[k]=W_r[k]+jW_i[k]k=0, \ldots, \lfloor (L+1)/2 \rfloor \tag{20}$$

and using the Eulerian identity to replace exponential quantities by trigonometrical functions, (18) may be represented as:

$$\mathring{w}[n] = W_r[0] + \sum_{k=1}^{\lfloor (L/2-1) \rfloor} \left[2W_r\cos\left(\frac{2\pi}{L}nk\right) - 2W_i\sin\left(\frac{2\pi}{L}nk\right)\right] + W_r\left[\frac{L}{2}\right](-1)^n \tag{21}$$

Thus, the last term $$W_r\left[\frac{L}{2}\right](-1)^n$$

will only be non-zero if L is even-numbered. By introducing basic functions:

$$G_r(k, n) = \begin{cases} 1, & k = 0 \\ 2\cos\left(\frac{2\pi}{L}nk\right), & 1 \le k < L/2 \\ (-1)^n, & k = L/2 (L \text{ even}) \end{cases} \tag{22}$$

$$G_i(k, n) = \begin{cases} 0, & k = 0 \\ -2\sin\left(\frac{2\pi}{L}nk\right), & 1 \le k < L/2 \\ 0, & k = L/2 (L \text{ even}) \end{cases}, \tag{23}$$

the window $\mathring{w}[n]$ may be represented in a compact manner by:

$$\mathring{w}[n] = \sum_{k=0}^{\lfloor \frac{L+1}{2} \rfloor} W_r[n]G_r(k, n) + \sum_{k=1}^{\lfloor \frac{L-1}{2} \rfloor} W_i[n]G_i(k, n,). \tag{24}$$

This form may be used directly for an optimization-based design of W[k].

In order to describe limitations as regards non-zero elements of W[k] (sparsity constraints), the following index sets R and I are introduced:

$$\mathcal{R} = \{r_1, r_2, \ldots, r_R\}, 0 \le r_k \le \left\lfloor \frac{L+1}{2} \right\rfloor \tag{25}$$

$$\mathcal{I} = \{i_1, i_2, \ldots, i_I\}, 1 \le i_k \le \left\lfloor \frac{L-1}{2} \right\rfloor. \tag{26}$$

A real component $W_r[k]$ may only be non-zero if the index k is contained in the set R. The same relation applies between the imaginary component $W_i[k]$ and the set I. Using this relation, the time-domain window (24) for a predetermined set of contributing non-zero components of W[k] may be expressed as follows:

$$\hat{w}[n]=\sum_{k\in\mathcal{R}} W_r[n]G_r(k,n)+\sum_{k\in\mathcal{I}} W_i[n]G_i(k,n). \tag{27}$$

Thus, the design of W[k] may be indicated as an optimization problem in a matrix form:

$$\underset{W}{\text{minimize}}\|G\cdot W-\hat{w}\|_p. \tag{28}$$

The vector $\hat{w}$ represents the last B samples of the desired time-domain window $\hat{w}[n]$ (17), whereas W is the vector of non-zero components of W[k]:

$$W=[W_r[r_1]\ldots W_r[r_R]W_i[i_1]\ldots W_i[i_I]]^T \tag{29}$$

$$\hat{w}=[\hat{w}[L-B]\hat{w}[L-B+1]\ldots\hat{w}[L-1]]^T. \tag{30}$$

G is the matrix of the basic functions:

$$G=0pt\begin{bmatrix} G_r(r_1,L-B) & \ldots & G_r(r_r,L-B) & \ldots & G_r(i_I,L-B) \\ \vdots & \ddots & \vdots & \ddots & \vdots \\ G_r(r_1,L-1) & \ldots & G_r(r_r,L-1) & \ldots & G_r(i_I,L-1) \end{bmatrix}$$

In equation (28), $\|\cdot\|_p$ refers to the error norm used when minimizing, for example p=2, for a minimization pursuant to the least square method, or p=∞ for a Chebyshev (minimax) optimization.

In this document, the optimization problems are formulated and solved using CVX, a software package for convex optimization [19]. The problem (28) is expressed in the following CVX program:

```
cvx_begin
   variable W ( N_coeffs )
   minimize ( norm( (G*W - ŵ), p ));
   subject to <optional constraints>
cvx_end
```

This design specification may be adapted to the respective requirements of application by a plurality of additional restrictions. Examples of this are:

- Equality constraints or upper or lower limits for different values w[9], for example to ensure smoothness requirements at the beginning or the end of the time-domain window.
- Slope constraints of w[n], for example to avoid an oscillation behavior of the time-domain window. This is achieved by imposing constraints on the differences between successive values w[n].

Design Examples

A design example with a time-domain window length B=64 and the corresponding standard FFT size L=2B=128 illustrates the characteristics of the design method and the performance of the resulting window functions. The desired time-domain window is a linear slope decreasing from 1 to 0. Unequality constraints for the first and last coefficients:

$$1-\frac{1}{L}\le w[0]\le 1 \text{ and } \le w[B-1]\le\frac{1}{L} \tag{31}$$

prevent discontinuities at the beginning and the end of the transition. However, design experiments have shown that the constraints become active, that is influence the result, only for a very small number of non-zero coefficients.

The design experiments are performed relative to the $L_2$ and $L_\infty$ error norms for different sets of non-zero coefficients, wherein:

$$K=|R|+|\mathcal{I}| \tag{32}$$

refers to the overall number of non-zero components of W[k]. The resulting windows are shown in FIG. 1 and the designs are summed up in FIG. 7*g*. FIG. 6(*a*) shows a design with a complete set of 8 complex coefficients, that is K=15, since $W_i[0]=0$ (19). It is observed that the resulting design approximates the ideal time-domain window very well, with $L_2$ and $L_\infty$ error norms of $9.37\cdot10^{-6}$ and $5.65\cdot10^{-6}$. A design with 8 exclusively real coefficients is shown in FIG. 6(*b*). The figure shows visible deviations from the ideal window function, which also becomes clear from the error norms $5.45\cdot10^{-2}$ and $1.55\cdot10^{-2}$ for the $L_2$ and $L_\infty$ designs. In contrast, the design shown in FIG. 6(*c*) also exhibits K=8 non-zero components. However, this design nearly reaches the performance of the example with 8 complex coefficients since the non-zero values are specifically chosen from the set of real and imaginary components.

FIGS. 6(*d*) to 6(*f*) show further design examples with a decreasing number of non-zero components which, however, have been selected optimally. It is to be recognized that, even with numbers as low as K=3, relatively good approximations of the ideal time-domain window are possible. Although the final design with K=2 (FIG. 6(*f*)) shows considerable deviations from an ideal linear transition, it may be acceptable for many applications of filter crossfading since it provides a smooth transition with no signal discontinuities.

Efficient Implementations for Additional Reductions in Complexity

This section presents optimized implementations for two aspects of the frequency-domain crossfading algorithm and analyzes their performance. At first, an efficient implementation for a circular convolution of sparsely occupied conjugate-symmetrical sequences is suggested. Secondly, an optimization for constant-gain crossfading, as is used in binaural synthesis, is described.

Circular Convolution with Sparsely Occupied Sequences

A circular convolution of two general sequences is defined by the following convolution sum:

$$Y[k]=X[k]\circledast W[k]=\Sigma_{l=0}^{L-1}W[((l))_L]X[((k+l))_L]. \tag{33}$$

Thus, $((k))_L$=k mod L refers to the index modulo L (such as, for example, in [9]). This operation necessitates, for each element Y[k], L complex multiplications and L−1 complex additions, resulting in $L^2$ complex multiplications and L(L−1) additions for a complete convolution.

The conjugate symmetry of X[k] and W[k] and the sparse occupation of W[k] allows a more efficient representation:

$$Y[k]=X[k]W[0]+\Sigma_{l\in\{\mathcal{R}\cup\mathcal{I}\}\setminus 0}Y^{(l)}[k] \text{ with} \tag{34}$$

$$Y^{(l)}[k]=W[l]X[((k+l))]+\overline{W[l]}X[((k-l))_L]. \tag{35}$$

Thus, $\{\mathcal{R}\cup\mathcal{I}\}\setminus 0$ refers to the unification of the index sets $\mathcal{R}$ and $\mathcal{I}$ minus the index 0. It follows from the dual representation of the convolution theorem (16) that Y[k] is also conjugate-symmetrical. Thus, only ⌈(L+1)/2⌉ elements are necessitated in order to determine Y[k] unambiguously. When expressing $Y^{(l)}[k]$ by real and imaginary values, the result is:

$$Y^{(l)}[k]=(W_r[l]+jW_i[l])(X_r[((k+l))_L]+jX_i[((k+l))_L])+(W_r[l]-jW_i[l])(X_r[((k-l))_L]+jX_i[((k-l))_L]). \quad (36)$$

By calculating the intermediate values:

$$X^+[k,l]=X[((k+l))_L]+X[((k-l))_L] \quad (37)$$

$$X^-[k,l]=X[((k+l))_L]-X[((k-l))_L], \quad (38)$$

equation (36) is evaluated efficiently as:

$$Y^{(l)}[k]=W_r[l]X_r^+[k,l]-W_i[l]X_i^-[k,l]+j(W_r[l]X_i^+[k,l]+W_i[l]X_r^-[k,l]). \quad (39)$$

In combination, evaluating the sequence $Y^{(l)}[k]$ necessitates $4\lceil(L+1)/2\rceil$ real-valued multiplications and $2\lceil(L+1)/2\rceil$ additions. Thus, this implementation is more efficient than a direct evaluation of (35) using complex operations which would necessitate $8\lceil(L+1)/2\rceil$ real multiplications and $8\lceil(L+1)/2\rceil$ real additions. If W[I] is purely real or imaginary, either $W_i[I]$ or $W_r[I]$ will equal zero. In both cases, the complexity decreases to $2\lceil(L+1)/2\rceil$ real multiplications and $2\lceil(L+1)/2\rceil$ additions.

On the basis of these complexities, the result is an overall complexity for the evaluation of the circular convolution in accordance with (34) of $4K\lceil(L+1)/2\rceil$ real multiplications and $2(K-1)\lceil(L+1)/2\rceil$ real-valued additions, that is all in all $(6K-2)\lceil(L+1)/2\rceil$ operations. As is defined in (32), K refers to the overall number of non-zero components of W[I]. Thus, the overall complexity mentioned considers both the real-valuedness of W[0] and the fact that the index I of a general complex value W[I] is contained in both the index set $\mathcal{R}$ and in $\mathcal{I}$.

In this way, the conjugate symmetry of the sequences contributing to the circular convolution allows considerable savings as regards complexity. Additional significant reductions may be gained by window coefficients which are either purely real or imaginary. Thus, the suggested circular convolution algorithm may draw a direct advantage from sparsely occupied frequency-domain window functions, such as, for example, the designs illustrated in FIGS. 6*a* to 6*f*.

Constant-Gain Crossfading

Constant-gain crossfading which includes linear crossfading, as is usually used for transitions between HRTFS, may be implemented efficiently within the frequency-domain crossfading concept presented.

A general frequency-domain crossfading is implemented by a circular convolution of the two input signals with their respective frequency-domain windows and subsequent summation:

$$Y[k]=Y_1[k]\circledast W_1[k]+Y_2[k]\circledast W_2[k] \quad (40)$$

For constant-gain crossfading, a more efficient implementation is achieved by transforming the time-domain crossfading function (14) to the frequency domain:

$$Y[k]=Y_2[k]+s(Y_d[k])+(e-s)W[k]\circledast Y_d[k]. \quad (41)$$

Here $Y_d[k]$ refers to the following difference:

$$Y_d[k]=Y_1[k]-Y_2[k]. \quad (42)$$

As in (14), this function allows crossfading between any initial and final values s and e. The main advantage of the implementation (41) compared to (40) is that, it necessitates only a single circular convolution which then represents the most complicated part of the crossfading algorithm.

A further reduction in complexity may be achieved by fusing the circular convolution schemes (34) and (41). Combining the term containing the central window coefficients W[0] with the crossfading function has the following result:

$$Y[k]=Y_2[k]+(s+(e-s)W[0])Y_d[k]+(e-s)\Sigma_{l\in\{\mathcal{R}\cup\mathcal{I}\}\setminus 0}(W[l]Y_d[((k+l))_L]\overline{W[l]}Y_d[((k-l))_L]). \quad (43)$$

In this way, the computing complexity of constant-gain crossfading is determined by the sparsely occupied circular convolution operation described in section 4.1, two complex vector additions with a size $\lceil(L+1)/2\rceil$, two additions and 2K−1 multiplications for scaling the window coefficients W[k]. The overall result is $(6K-2)\lceil(L+1)/2\rceil+2$ additions and $4K\lceil(L+1)/2\rceil+2K-1$ real-valued multiplications. Thus, crossfading a block of B output samples necessitates a total amount of $(10K-2)\lceil(L+1)/2\rceil+2K+1$ instructions.

Figure 5B:
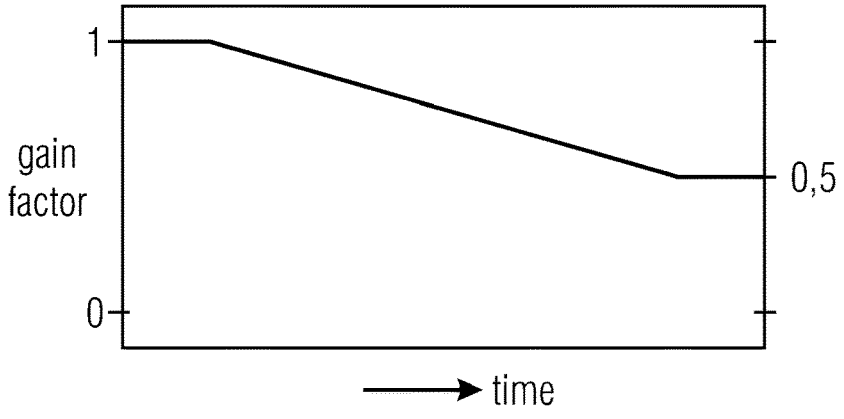
FIG. 5*b* shows a time-domain window function for a linear gain change as an example of any kind of gain change.
Figure 6A:
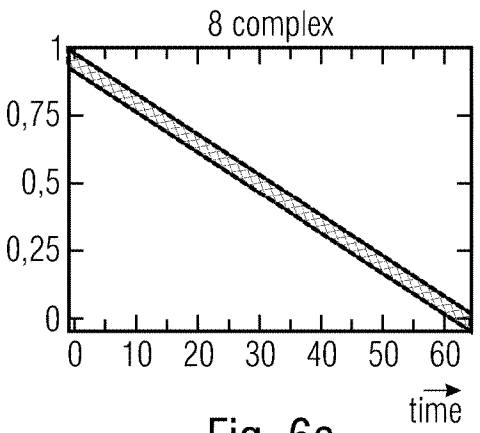
FIGS. 6*a*-6*f* show window design examples for different frequency-domain window coefficients.
Figure 6B:
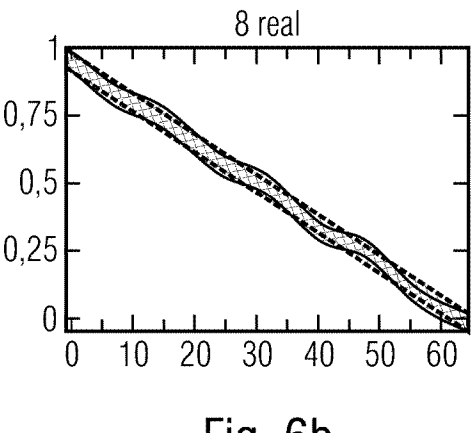
Figure 6C:
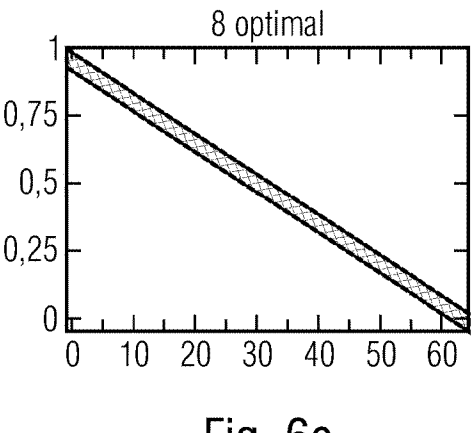
Figure 6D:
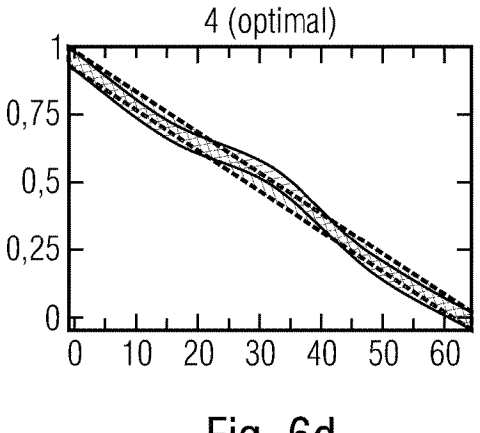
Figure 6E:
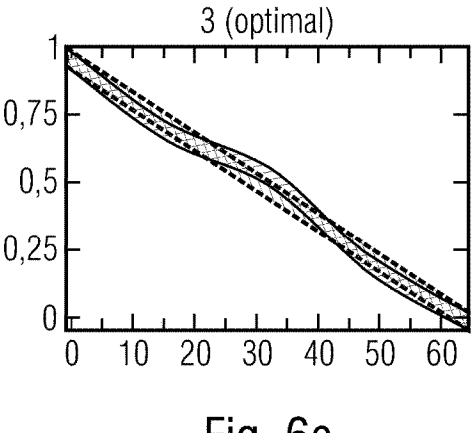
Figure 6F:
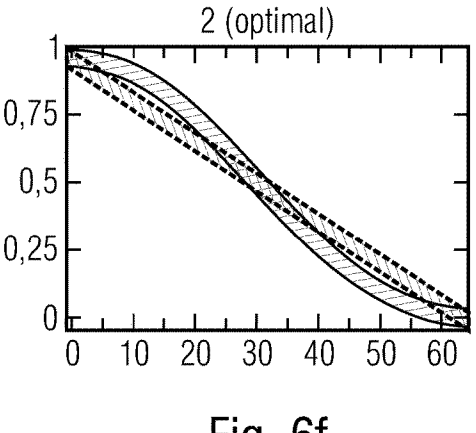
Figure 8A:
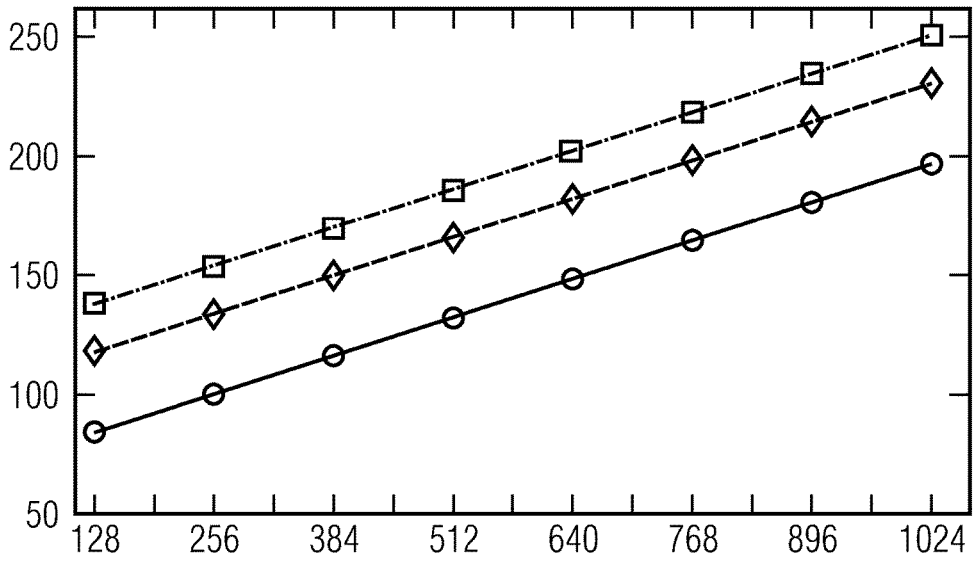
FIGS. 8*a*-8*d* show overview charts for the complexity of the frequency-domain convolution algorithms with filter crossfading as a number of instructions per output sample.
Figure 8B:
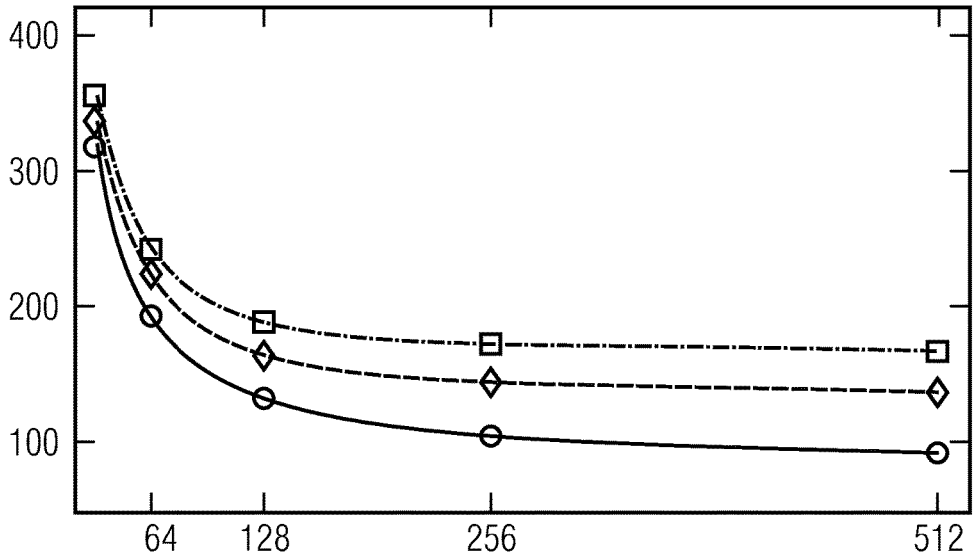
Figure 8C:
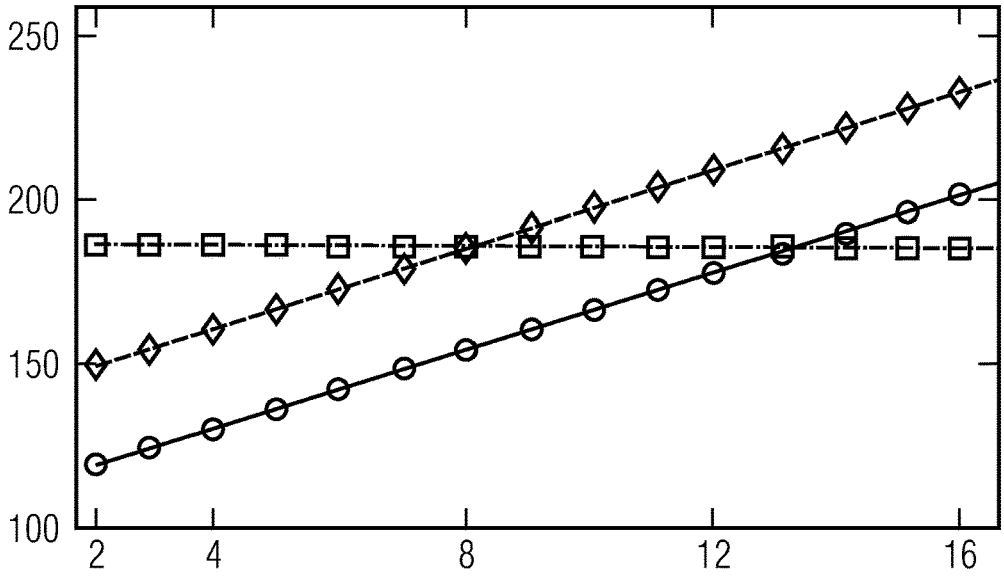
Figure 8D:
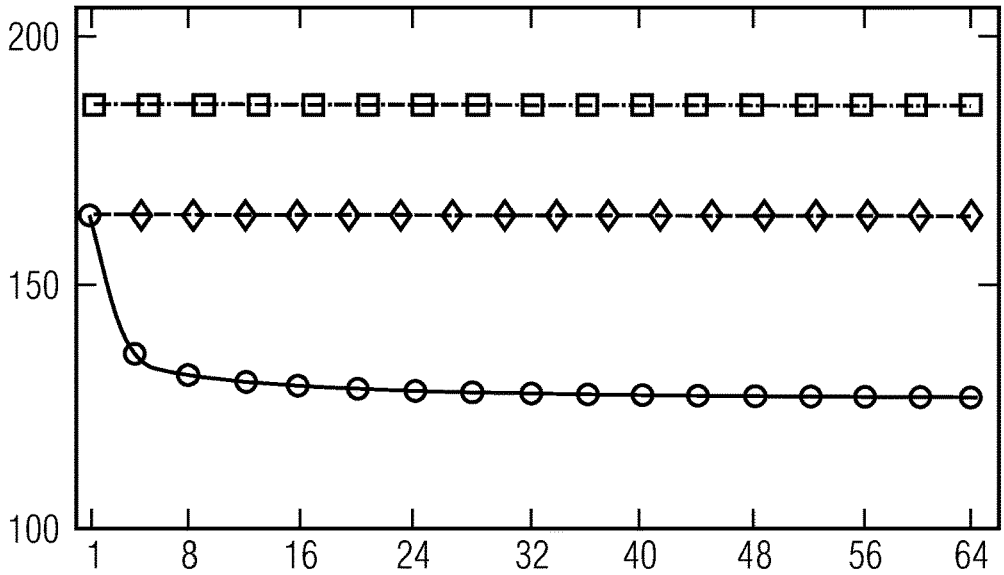

In analogy to FIG. 5*a*, FIG. 5*b* shows an alternative time-domain window representation which represents a gain change, for example from a gain factor 1 to a gain factor 0.5. Such a time-domain window roughly corresponds to the fade-out window $w_1$ in FIG. 5*a*; however, there is no fading-in here. For the time-domain window in FIG. 5*b* as well, there are efficient frequency-domain window functions which may be used efficiently in block 124 or in blocks 124*a*, 124*b*, 124*c* of FIGS. 1, 2 and 3.

The representations of the frequency-domain window function for the time-domain window of FIG. 5*b* may be represented from the frequency-domain representations for the window functions of FIG. 5*a* by scaling or by adding/subtracting corresponding values so that no new optimizations have to be performed, for example, but the corresponding frequency-domain window functions for all the gain changes in the frequency domain may be generated from existing frequency-domain window functions based on FIG. 5*a*, or as they are defined in FIGS. 6*a* to 6*f*. Thus, a reduction in gain may be achieved by FIG. 5*b*. Alternatively, an increase in gain may be achieved by a corresponding function, wherein here the function $w_2$ of FIG. 5*a* may be used again with correspondingly scaling and/or adding corresponding, for example constant, values.

FIG. 11 exemplarily shows a signal processing structure for a gain change with any initial and final values using a single, fixed frequency-domain window function. Thus, $Y_1[k]$ 502 represents the frequency-domain representation of the signal to be subjected to a gain change. This signal may, for example, have been generated by frequency-domain filtering of an input signal. However, such filtering is not absolutely necessary. It is only necessitated for the signal to be present in a representation compatible with the frequency-time domain transform used (in the description referred to as "converter"); that is for applying the frequency-time domain transform to generate the corresponding time-domain signal $y_1[n]$. The course of the gain function here is determined by the gain value s at the beginning of a signal block, the gain factor e at the end of the signal block, and the selected frequency-domain window function, which here is referred to by $W_2[k]$. Exemplarily, this is executed such that the time-domain correspondence thereof is a function decreasing from 1 to 0. A gain change is performed by means of the following computing function also illustrated in FIG. 11.

$$Y[k]=sY_1[k]+(e-s)(W_2[k]\circledast Y_1[k]).$$

The signal $Y_1[k]$ is provided with a frequency-domain window function $W_2[k]$ by means of a circular convolution. The result of this convolution is scaled by multiplying the vector by the value e−s in a first multiplier 503 element by element. Due to the linearity of the circular convolution, the scaling may also be applied to either $Y_1[k]$ or $W_2[k]$ before the convolution. The result of this representation is summed in the summer 500 with the signal $Y_1[k]$ scaled by the initial gain value s in a second multiplier 504 and results in the frequency-domain output signal Y[k]. The efficiency may be increased further by, in analogy to (43), separating the central window coefficient W[0] from the convolution sum and considering same when scaling $Y_1[k]$.

$$Y[k]=sY_1[k]+(e-s)(W_2[k]\circledast Y_1[k]).$$

FIGS. 7*a* to 7*f* show a chart of the filter coefficients of the frequency-domain window functions which are represented in the time domain in FIGS. 6*a* to 6*f*. The frequency-domain window functions are only sparsely occupied. In particular, FIG. 7*a* shows a frequency-domain representation where the bin of the frequency-domain representation of the window function, corresponding to the frequency 0, or the 0-th bin has a value of 0.5. The exact value "0.5" here is not absolutely necessary. 0.5 for the 0-th bin means that the average of the time-domain values is 0.5, which applies for even crossfading from 1 to 0.

The first to seventh frequency bins will then have the corresponding complex coefficients, whereas all further, higher bins equal 0 or exhibit such small values that they are nearly of no importance. The set $_{\mathcal{R}}$ and the value $_{\mathcal{I}}$ from FIGS. 7*a* to 7*f* thus describe the indices of the non-zero real and imaginary parts of the spectral coefficients or bins of the frequency-domain window functions which are illustrated in the time domain in FIGS. 6*a* to 6*f*. FIGS. 7*e* and 7*f*, for example, only relate to occupying the first three spectral coefficients of the window function (FIG. 7*e*) or only the first two spectral coefficients of the window function (FIG. 7*f*).

Complexity Evaluation

This section compares the complexity of the suggested frequency-domain crossfading algorithm to existing solution approaches of filter crossfading. A rendering system with a filter length N=512, a block size B=128 and the corresponding standard DFT size L=256, M=8 virtual sources and K=4 non-zero coefficients for the frequency-domain crossfading method, is taken as a basis for evaluating the performance. Each of the parameters is varied to evaluate its influence on the overall complexity. The results are shown in FIG. 8. It shows the number of multiplications for computing a sample of an individual crossfaded signal, i.e. the overall number of operations in the rendering system divided by the number of sound sources. Three algorithms are considered: (a) partitioned convolution which is followed by time-domain crossfading, (b) the suggested FD crossfading algorithms which are performed separately for each source signal, and the summation of the ear signals in the time domain, and (c) FD crossfading and summation of the ear signals in the frequency domain.

FIG. 8(*a*) shows the influence of the filter length N. For a constant block size B, the complexity is a linear function of N for all algorithms, since N influences only the complexity which may be attributed to the block convolution (6), which is identical for the three algorithms. Nevertheless, the suggested FD crossfading algorithm, even in the case of a single channel, shows a measurable improvement compared to the time-domain solution approach. As is indicated by the third graph, summation of the ear signals in the frequency domain results in considerable additional reductions in complexity, that is from ≈186 to ≈131 instructions per sample for N=512.

The influence of the block size of the partitioned convolution scheme is shown in FIG. 8(*b*). While an FD crossfading is more efficient than time-domain crossfading in any case, the relative gain increases with an increasing block size B. This may be attributed to the complexity characteristics of uniformly partitioned convolution schemes. For small block sizes, the complexity is dominated by the block convolution (6), whereas the costs of the FFT and IFFT operations are negligible. Since a decrease in the number of IFFTs is the main feature of the FD crossfading method, its full effect only becomes visible for sufficiently large block sizes. However, this is only a small disadvantage since a uniformly partitioned convolution becomes more inefficient for very small block sizes in any case (see, for example, [12], [13]). At the other end of the scale, the largest improvements are made if the block size equals the filter length (in this example N=B=512). This corresponds to a non-partitioned fast convolution. Thus, the suggested FD crossfading in connection with overlap-save-schemes may be employed advantageously if the latency time caused by this is acceptable.

The dependence of the complexity on the sparse occupation of the FD window, that is the non-zero real and imaginary parts of values of the frequency-domain window function W[l], is shown in FIG. 8(*c*). For time-domain crossfading, the performance flow is a constant where no such windows are used. For the case of a channel-by-channel implementation of the algorithm, FD crossfading is more efficient in the set-up considered for up to about 7 non-zero components. As has been shown under the section "*Design of Frequency-Domain Windows*", windows of 3 to 4 values usually already allow very good approximations of linear crossfading. This allows practical compromises between precision and complexity of crossfading and, in most applications, a considerable acceleration. Further considerable increases in precision or efficiency are possible when mixing the ear signals is also performed in the frequency domain. In this case, in FD windows of up to 12 coefficients, FD crossfading is more efficient than the time-domain method.

FIG. 8(*d*) shows the effect of the size of the acoustic scene reproduced, i.e. the number of virtual sources, on the overall complexity. As is illustrated above, the calculated numbers of arithmetic operations are normalized by the number of calculated sources. For time-domain crossfading and the single-channel FD algorithm, the complexity is not dependent on the scene size. Also, the multi-channel FD algorithm for a single source is identical to the single-channel FD crossfading. However, a combination of the crossfaded source signals in the frequency domain allows considerable gains in efficiency even for small acoustic scenes, for example for M=2, . . . , 8. Larger acoustic scenes only allow small additional gains in performance. This asymptotic limit results from the influence of the forward FFT and block convolution operations on the overall complexity. It cannot be reduced further by reducing the number of inverse FFT operations.

Embodiments relate to an efficient algorithm which combines frequency-domain convolution and crossfading of filtered signals. It is applicable to a plurality of frequency-domain convolution techniques, in particular overlap-save and uniformly or non-uniformly partitioned convolution. Also, it may be used with different kinds of smooth transitions between filtered audio signals, including gain changes and crossfading. Constant-gain crossfading, like, for example, linear filter transitions, which are usually necessitated in dynamic binaural synthesis, allow additional considerable reductions in complexity. The novel algorithm is based on a circular convolution in the frequency-domain with a sparsely occupied window function which consists of only a few non-zero values. In addition, a flexible optimization-based design method for such windows is illustrated. Design examples confirm that the crossfading behaviors which are usually employed in audio applications may be approximated very well by very sparsely occupied window functions.

The suggested embodiments show considerable improvements in performance compared to previous solutions which are based on two separate convolutions and time-domain crossfading. However, the full potential of frequency-domain crossfading for binaural applications is only made use of when integrated into the structure of a binaural reproduction system. In this case, the novel crossfading algorithm allows performing larger portions of processing in the frequency-domain, thereby decreasing the number of inverse transforms considerably. The advantages of this solution approach for binaural synthesis have been shown. In this application, the ability of mixing the signals of several sound sources and frequency-domain allows considerable reductions in complexity. Nevertheless, the algorithm suggested is not limited to binaural synthesis, but probably applicable to other usage purposes which use both techniques of fast convolution and temporally varying mixing of audio signals, in particular in multi-channel applications.

Alternative embodiments of the present invention will be illustrated below. Generally, embodiments of the present invention relate to the following points.

Gradually fading-in or fading-out a (filtered) signal $y_i[n]$ may generally be interpreted as multiplying the signal by a time-domain window function $w_i[n]$.

Crossfading between two filtered signals ($y_1[n]$ and $y_2[n]$) may thus be represented by multiplying the signals by the window function $w_1[n]$ and $w_2[n]$ and a subsequent summation thereof.

$$y[n] = w_1[n]y_1[n] + w_2[n]y_2[n] \text{ with} \tag{44}$$

$$y_1[n] = \sum_{k=0}^{N} h_1[k]x[n-k] \text{ and } y_2[n] = \sum_{k=0}^{N} h_2[k]x[n-k]. \tag{45}$$

A special kind of crossfading is the so-called constant-gain crossfade where the sum of the window functions $w_1[n]$ and $w_2[n]$ for each n has a value of 1. This type of crossfading is practical in many applications, in particular when the signals to be blended (or filters) are strongly correlated. In this case, crossfading may be represented by an individual window function w[n], w1[n]=w[n], w2[n]=1−w[n], and the crossfade (1) may be represented as follows:

$$y[n]=y_2[n]+w[n](y_1[n]-y_2[n]). \tag{46}$$

The aim of this method is performing crossfading directly in the frequency-domain and thereby reducing the complexity resulting when executing two complete fast convolution operations. More precisely, this means that when crossfading the filtered signals in the frequency-domain, only one instead of two inverse FFTs are necessitated.

For deriving the crossfade in the frequency-domain, only the multiplication of an individual signal x[n] by a time-domain window function w[n] will be considered:

$$y[n]=x[n]\cdot w[n] \tag{47}$$

An extension to crossfades in correspondence with formulae (44) and (46) may, after having described the core algorithm, take place easily (but allow further additional gains in performance).

An element-by-element multiplication in the time-domain (47) corresponds to a circular (periodic) convolution in the frequency-domain.

$$DFT\{x[n]\cdot w[n]\} = \frac{1}{L} DFT\{x[n]\} \circledast DFT\{w[n]\}, \tag{48}$$

Thus, DFT $\{\cdot\}$ represents the discrete Fourier transform and $\circledast$ represents a circular convolution of two finite, that is here usually complex sequences the length of which is referred to by L.

Crossfading by a circular convolution in the frequency-domain may be integrated into fast convolution algorithms, like overlap-save, partitioned and non-uniformly partitioned convolution. Thus, the peculiarities of these methods, for example zero padding of the implulse response segments and discarding part of the signal retransformed to the time-domain (for avoiding circular over-convolution of the time-domain signal, time-domain aliasing), are to be considered correspondingly. The length of crossfading here is determined to be the block size of the convolution algorithm or a multiple thereof.

The convolution (48) is typically considerably more complicated than crossfading in the time-domain (47) (complexity $0(L^2)$). Thus, shifting to the frequency domain generally means a significant increase in complexity since the additional complexity $0(L^2)$ exceeds the reduction by saving the FFT $0(L \log_2 L)$ considerably. In addition, operations, like a weighted summation in the frequency-domain correspondence of (44) are more expensive since the sequences are complex-valued.

An embodiment is finding frequency-domain window functions W[k] which only comprise very few non-zero coefficients. With very sparsely occupied window functions, the circular convolution in the frequency-domain may become considerably more efficient than an additional inverse FFT followed by crossfading in the time-domain.

It is shown that there are such window functions using which, with a small number of coefficients, a very good approximation to desired crossfade characteristics is possible.

An optimization method is introduced with which an optimal frequency-domain window W[k] may be found for a desired time-domain window function $\hat{w}[n]$ and the prerequisite which real-valued and imaginary coefficients of the frequency-domain window function may differ from zero.

With this optimization, the characteristics of the overlap-save algorithm and the uniformly and non-uniformly partitioned convolution algorithms based thereon may be made use of in a practical manner. Only the last B samples are used by the inverse discrete Fourier transform $\mathring{w}[n]$:

$$\mathring{w}[n] = L\cdot DFT^{-1}\{W[k]\} = \sum_{k=0}^{L-1} W[k]e^{j\frac{2\pi}{L}nk}$$

wherein B is the block size or block feed of the partitioned convolution algorithm (B<L). The first L−B values of the retransformed output signal and, thus, the effect of multiplication by the first L−B values of $\mathring{w}[n]$ are discarded for avoiding time-domain aliasing by the convolution algorithm. Thus, the window coefficients $\hat{w}[0] \ldots \hat{w}[L-B]$ may take any values without thereby altering the crossfade result. These additional degrees of freedom result in a considerable advantage when designing frequency-domain windows W[k] with a small number of non-zero coefficients.

When designing W[k] and efficiently implementing the circular convolution in the frequency-domain, the symmetrical-conjugate structure of the frequency-domain window may be made use of in a practical manner. Thus, it is practical to consider the real and imaginary components of W[k] separately.

Different designs for such frequency-domain windows are presented (among others with 2, 3 and 4 non-zero coefficients), which comprise a specific, specifically chosen distribution of the real-valued and imaginary non-zero coefficients. The findings obtained, strictly speaking, apply only to the window designs presented here (that is, for example, for the predetermined values L and B and the form of the desired crossfade). However, the underlying principles, for example advantageous distributions of real and imaginary non-zero parts, may also be applied to other values for B and L.

The distribution of the real-valued and imaginary non-zero components is highly characteristic. The distribution, as is, for example, used in the third design in FIG. 7*g* (8 non-zero coefficients, index sets $_{\mathcal{R}}=\{0,1,3,5,7\}$, $_{\mathcal{I}}=\{2,4,6\}$, has been found out in additional examinations to be optimal also for other parameter combinations in embodiments. This means that a particularly suitable setting for the frequency-domain window function is that the coefficients with an index 0 and all odd indices are purely real and the coefficients with an even index (starting from 2) are purely imaginary.

A window function with two non-zero coefficients (last design example in FIG. 7*g*, picture 6(*f*)) allows a smooth transition between two filters or signals and may also be used for constant-gain crossfading. This window function corresponds to a time-domain window with a half-side window of the cosine type (for example Hann- or Hamming-window). Although this window function deviates from a linear crossfade relatively strongly, it should be employable already for many applications where only crossfading, free from clicking, between rather similar filters is necessitated.

Efficient implementations and different optimizations are presented for the implementation of the circular convolution with a sparsely occupied conjugate-symmetrical window function W[k] (as considered here). Thus, it becomes clear that a separate consideration of the real and imaginary non-zero parts offers performance advantages.

For realizing constant-gain crossfades, a further optimized computing rule is introduced.

The invention described allows further considerably greater performance advantages when systems having several inputs and outputs are considered. In this case, by the implementation of crossfading in the frequency domain (or of the signal representation predetermined by the fast convolution algorithm used), a larger part of the entire calculation may take place in this frequency domain, thereby considerably increasing the overall efficiency.

An effect of the invention described is a reduction in the computing complexity. Thus, certain deviations (which, however, may be influenced and usually be kept very small) compared to an ideal predetermined form of crossfading are acceptable.

Apart from this increase in efficiency, the concept allows integrating crossfading functionalities directly in the frequency domain. As has been described above, larger signal processing algorithms which use crossfading as an element may be restructured such that the result is an increase in efficiency. Larger parts of the full signal processing may, for example, be performed in the frequency-domain representation, thereby reducing the complexity for transforming the signals considerably (for example the number of retransforms to the time domain).

Generally, embodiments may be used in all applications which necessitate an FIR convolution with a certain minimum length of the filters (depending on the hardware starting from approximately 16-50 coefficients) and in which the filter coefficients are to be exchanged without any signal processing artefacts at runtime.

Two fields of application in the audio field are deemed to be particularly important:

Binaural Synthesis

When reproducing sound scenes via headphones, the signals of the sound objects are filtered by so-called head-related transfer functions (HRTFs) of both ears and the signals reproduced via the headphones are formed by summation of the corresponding component signals. The HRTFs depend on the relative position of the sound source and the listener and, thus, are exchanged with moving sound sources or head movements. The requirement of filter crossfading is known, for example [5; 14].

Variable Digital Filter Kernel for Beamforming

Beamforming applications (both for loudspeakers and for microphone arrays) with a directional pattern controllable at runtime necessitate variable digital filter structures using which the characteristics of array processing may be adjusted continuously. Thus, it has to be ensured that the change of the pattern does not generate any interferences (for example clicking artefacts, transients). When implementing the variable filters by means of a fast convolution, the invention described may be applied in an advantageous manner.

Particularly, in this implementation the frequency-domain signal is an audio signal. The first filter characteristic refers to a filter for a certain sound converter (microphone or loudspeaker) in a sound converter array, which is suitable to form a desired first directional pattern at a first point in time in combination with the other sound converters of the sound converter array. The second filter characteristic describes a filter for a certain sound converter (microphone or loudspeaker) in a sound converter array, which is suitable to form a second desired directional pattern at a second point in time in combination with the other sound converters of the sound converter array such that the directional pattern is varied over time by crossfading while using the frequency-domain window function.

Another application relates to using several audio signals the filtered and crossfaded frequency-domain representations of which are combined before the inverse Fourier transform. This corresponds to simultaneously radiating several audio beams with different signals via a loudspeaker array, or to a summation of the individual microphone signals in a microphone array.

The invention described may be applied with particular advantage to systems with several inputs and outputs (multiple-input, multiple-output, MIMO), for example when several crossfades take place simultaneously or several crossfaded signals are combined and processed further. In this case, it is possible to execute a larger part of the full calculation (or of the signal representation predetermined by the used overlap-save or partitioned convolution algorithm) in the frequency domain. By shifting further operations, like summation, mixing signals etc., the complexity for the retransform to the time domain may be reduced considerably and, thus, the overall efficiency frequently be improved significantly. Examples of such systems are, as described above, binaural rendering for complex audio scenes or also beamforming applications where signals for different directional patterns and converters (microphones or loudspeakers) are filtered by varying filters and have to be combined with one another.

Although some aspects have been described in the context of a device, it is clear that these aspects also represent a description of the corresponding method such that a block or element of a device also corresponds to a respective method step or a feature of a method step. Analogously, aspects described in the context of a method step also represent a description of a corresponding block or detail or feature of a corresponding device. Some or all of the method steps may be executed by (or using) a hardware apparatus, like, for example, a microprocessor, a programmable computer or an electronic circuit. In some embodiments, some or several of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray disc, a CD, an ROM, a PROM, an EPROM, an EEPROM or a FLASH memory, a hard drive or another magnetic or optical memory having electronically readable control signals stored thereon, which cooperate or are capable of cooperating with a programmable computer system such that the respective method is performed. Therefore, the digital storage medium may be computer-readable.

Some embodiments according to the invention include a data carrier comprising electronically readable control signals, which are capable of cooperating with a programmable computer system such that one of the methods described herein is performed.

Generally, embodiments of the present invention can be implemented as a computer program product with a program code, the program code being operative for performing one of the methods when the computer program product runs on a computer.

The program code may, for example, be stored on a machine-readable carrier.

Other embodiments comprise the computer program for performing one of the methods described herein, wherein the computer program is stored on a machine readable carrier. In other words, an embodiment of the inventive method is, therefore, a computer program comprising a program code for performing one of the methods described herein, when the computer program runs on a computer.

A further embodiment of the inventive methods is, therefore, a data carrier (or a digital storage medium or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may, for example, be configured to be transferred via a data communication connection, for example via the Internet.

A further embodiment comprises processing means, for example a computer, or a programmable logic device, configured to or adapted to perform one of the methods described herein.

A further embodiment comprises a computer having installed thereon the computer program for performing one of the methods described herein.

A further embodiment according to the invention comprises a device or a system configured to transfer a computer program for performing at least one of the methods described herein to a receiver. The transmission can be performed electronically or optically. The receiver may, for example, be a computer, a mobile apparatus, a memory apparatus or the like. The device or system may, for example, comprise a file server for transferring the computer program to the receiver.

In some embodiments, a programmable logic device (for example a field-programmable gate array, FPGA) may be used to perform some or all of the functionalities of the methods described herein. In some embodiments, a field-programmable gate array may cooperate with a microprocessor in order to perform one of the methods described herein. Generally, in some embodiments, the methods may be performed by any hardware device. This can be a universally applicable hardware, such as a computer processor (CPU), or hardware specific for the method, such as an ASIC.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] V. R. Algazi und R. O. Duda, "Headphone-based spatial sound," IEEE Signal Processing Mag., Vol. 28, No. 1, pp. 33-42, January 2011.

[2] R. Nicol, Binaural Technology, ser. AES Monographs. New York, N.Y.: AES, 2010.

[3] D. N. Zotkin, R. Duraiswami, und L. S. Davis, "Rendering localized spatial audio in a virtual auditory space," IEEE Trans. Multimedia, Vol. 6, No. 4, pp. 553-564, August 2004.

[4] A. Härmä, J. Jakka, M. Tikander, et al., "Augmented reality audio for mobile and wearable appliances," J. Audio Eng. Soc., Vol. 52, No. 6, pp. 618-639, June 2004.

[5] J.-M. Jot, V. Larcher und O. Warusfel, "Digital signal processing issues in the context of binaural and transaural stereophony," in AES 98th Convention, Paris, France, February 1995.

[6] H. Gamper, "Head-related transfer function interpolation in azimuth, elevation and distance," J. Acoust. Soc. Am., Vol. 134, No. 6, EL547-EL553, December 2013.

[7] V. Algazi, R. Duda, D. Thompson, et al., "The CIPIC HRTF database," in Proc. IEEE Workshop Applications Signal Processing to Audio and Acoustics, New Paltz, N.Y., October 2001, pp. 99-102.

[8] T. G. Stockham Jr., "High-speed convolution and correlation," in Proc. Spring Joint Computer Conf., Boston, Mass., April 1966, pp. 229-233.

[9] A. V. Oppenheim und R. W. Schafer, Discrete-Time Signal Processing, 3th edition, Upper Saddle River, N.J.: Pearson, 2010.

[10] B. D. Kulp, "Digital equalization using Fourier transform techniques," in AES 85th Convention, Los Angeles, Calif., November 1988.

[11] F. Wefers und M. Vorländer, "Optimal filter partitions for real-time FIR filtering using uniformly partitioned FFT-based convolution in the frequency-domain," in Proc. 14. Int. Conf. Digital Audio Effects, Paris, France, September 2011, pp. 155-161.

[12] W. G. Gardner, "Efficient convolution without input-output delay," J. Audio Eng. Soc., Vol. 43, No. 3, pp. 127-136, March 1995.

[13] G. Garcia, "Optimal filter partition for efficient convolution with short input/output delay," in 113th AES Convention, Los Angeles, Calif., October 2002.

[14] C. Tsakostas und A. Floros, "Real-time spatial representation of moving sound sources," in AES 123th Convention, New York, N.Y., October 2007.

[15] J. O. Smith III, Introduction to Digital Filters with Audio Applications. W3K Publishing, 2007. [Online]. available: http://ccrma.stanford.edu/-jos/filters/.

[16] C. Müller-Tomfelde, "Time-varying filter in non-uniform block convolution," in Proc. COST G-6 Conf. Digital Audio Effects (DAFX-01), Limerick, Ireland, December 2001.

[17] J. O. Smith III, Mathematics of the Discrete Fourier Transform (DFT). W3K Publishing, 2007. [Online]. available: http://ccrma.stanford.edu/-jos/mdft/mdft.html.

[18] R. G. Lyons, Understanding Digital Signal Processing, 3rd ed. Upper Saddle River, N.J.: Pearson, 2011.

[19] M. C. Grant und S. P. Boyed, "Graph implementations for nonsmooth convex programs," in Recent Advances in Learning and Control, V. Blondel, S. Boyd, und H. Kimura, Eds., London, UK: Springer, 2008, pp. 95-110.

[20] F. Wefers und M. Vorländer. "Optimal Filter Partitions for Non-Uniformly Partitioned Convolution". In: Proc. AES 45th Int. Conf. Espoo, Finland, March 2012, pp. 324-332.

The invention claimed is:

1. A device for processing a discrete-time signal, comprising:

a processor stage configured to:

filtering the signal which is present in a discrete frequency-domain representation by a filter with a filter characteristic by means of a multiplication by a transfer function in order to acquire a filtered signal, providing the filtered signal with a frequency-domain window function in order to acquire a windowed signal, wherein the providing the filtered signal with a frequency-domain window function comprises performing multiplications of frequency-domain window coefficients of the frequency-domain window function by spectral values of the filtered signal in order to acquire multiplication results, and summing up the multiplication results; and a converter for converting the windowed signal or a signal determined using the windowed signal to a time domain in order to acquire the processed signal, wherein the filter comprises a necessitated filter characteristic at a first point in time, a further filter comprises a necessitated filter characteristic at a second, later point in time, and wherein the frequency-domain window function approximates a fade-out function in the time domain and a second frequency-domain window function approximates a fade-in function in the time domain, or wherein the processor stage is configured to use the frequency-domain window function which, in the time domain, is a fade-out function, and to use a further frequency-domain window function which, in the time domain, is a fade-in function, and wherein the processor stage is configured to use the frequency-domain window function and the further frequency-domain window function to at least approximate a constant-gain characteristic, wherein a sum of the first window function and the second window function at each discrete point in time is one or at least approximates one, or wherein the processor stage is configured to filter the signal which is present in the frequency-domain representation by a further filter with a further filter characteristic, to form a combination signal from the filtered signal and the further filtered signal, to provide the combination signal with the frequency-domain window function in order to acquire a windowed combination signal, and to combine the windowed combination signal with the filtered signal or the further filtered signal, and wherein the processor stage is configured to form a difference of the windowed signal and the further windowed signal as the combination signal, and wherein the processor stage is configured to combine the windowed combination signal with the further filtered signal, and wherein the converter is configured to convert the combined signal or a signal comprising a further signal in addition to the combined signal, to the time domain, or wherein the frequency-domain window function comprises a temporally increasing gain function or a temporally decreasing gain function, and wherein the processor stage is configured to combine the windowed signal and the filtered signal by means of a combiner, the combiner comprising: a first multiplier for multiplying the windowed signal by a first value; a second multiplier for multiplying the filtered signal by a second value; and a summer for summing up the multiplier output signals.

2. The device in accordance with claim 1, wherein the processor stage is further configured to:

filter the signal which is present in the frequency domain by a further filter with a further filter characteristic in order to acquire a further filtered signal, provide the further filtered signal with a further frequency-domain window function in order to acquire a further windowed signal, and combine the windowed signal and the further windowed signal.

3. The device in accordance with claim 1, wherein the processor stage is configured to filter the signal which is present in a frequency-domain representation by a further filter with a further filter characteristic, to form a combination signal from the filtered signal and the further filtered signal, to provide the combination signal with the frequency-domain window function in order to acquire a windowed combination signal, and to combine the windowed combination signal with the filtered signal or the further filtered signal.

4. The device in accordance with claim 1, wherein the time-domain signal is an audio signal and the signal which is present in the frequency domain is an audio signal transformed to the frequency domain.

5. The device in accordance with claim 1, wherein the frequency-domain window function or the further frequency-domain windowing comprises at most 15 or at most 8 non-zero coefficients.

6. The device in accordance with claim 1, wherein the filter characteristic or the further filter characteristic are HRTF filters for different positions and the signal which is present in the frequency-domain representation is an audio signal for a source at the different positions.

7. The device in accordance with claim 1, wherein the processor stage is configured to use the frequency-domain filter characteristic, the further frequency-domain filter characteristic or even further frequency-domain filter characteristics which represent a fade-in function, a fade-out function or a crossfading function or a gain change function in the time domain.

8. The device in accordance with claim 1, wherein the first value is a difference of a gain value of the frequency-domain window function at the beginning of a signal block and a gain value the of frequency-domain window function at an end of the signal block, and wherein the second value is the gain value of the frequency-domain window function at the beginning of the signal block.

9. A method for processing a signal, comprising:

filtering the signal which is present in a frequency-domain representation by a filter with a filter characteristic by means of a multiplication by a transfer function in order to acquire a filtered signal;

providing the filtered signal with a frequency-domain window function in order to acquire a windowed signal, wherein the providing the filtered signal with a frequency-domain window function comprises performing multiplications of frequency-domain window coefficients of the frequency-domain window function by spectral values of the filtered signal in order to acquire multiplication results, and summing up the multiplication results; and converting the windowed signal or a signal determined using the windowed signal to a time domain in order to acquire the processed signal, wherein the filter comprises a necessitated filter characteristic at a first point in time, a further filter comprises a necessitated filter characteristic at a second, later point in time, and wherein the frequency-domain window function approximates a fade-out function in the time domain and a second frequency-domain window function approximates a fade-in function in the time domain, or wherein the frequency-domain window function is, in the time domain, a fade-out function, and a further frequency-domain window function is used, which, in the time domain, is a fade-in function, and wherein the frequency-domain window function and the further frequency-domain window function at least approximate a constant-gain characteristic, wherein a sum of the first window function and the second window function at each discrete point in time is one or at least approximates one, or wherein the signal which is present in the frequency-domain representation is filtered by a further filter with a further filter characteristic, wherein a combination signal from the filtered signal and the further filtered signal is formed, wherein the combination signal is provided with the frequency-domain window function in order to acquire a windowed combination signal, and wherein the windowed combination signal is combined with the filtered signal or the further filtered signal, and wherein a difference of the windowed signal and the further windowed signal is formed as the combination signal, and wherein the windowed combination signal is combined with the further filtered signal, and wherein the combined signal or a signal comprising a further signal in addition to the combined signal is converted to the time domain, or wherein the frequency-domain window function comprises a temporally increasing gain function or a temporally decreasing gain function, and wherein the windowed signal and the filtered signal are combined by means of a combiner, the combiner comprising: a first multiplier for multiplying the windowed signal by a first value; a second multiplier for multiplying the filtered signal by a second value; and a summer for summing up the multiplier output signals.

10. A non-transitory digital storage medium having stored thereon a computer program for executing when said computer program is run by a computer, a method for processing a signal, comprising:

filtering the signal which is present in a frequency-domain representation by a filter with a filter characteristic by means of a multiplication by a transfer function in order to acquire a filtered signal;

providing the filtered signal with a frequency-domain window function in order to acquire a windowed signal, wherein the providing the filtered signal with a frequency-domain window function comprises performing multiplications of frequency-domain window coefficients of the frequency-domain window function by spectral values of the filtered signal in order to acquire multiplication results, and summing up the multiplication results; and converting the windowed signal or a signal determined using the windowed signal to a time domain in order to acquire the processed signal, wherein the filter comprises a necessitated filter characteristic at a first point in time, a further filter comprises a necessitated filter characteristic at a second, later point in time, and wherein the frequency-domain window function approximates a fade-out function in the time domain and a second frequency-domain window function approximates a fade-in function in the time domain, or wherein the frequency-domain window function is, in the time domain, a fade-out function, and a further frequency-domain window function is used, which, in the time domain, is a fade-in function, and wherein the frequency-domain window function and the further frequency-domain window function at least approximate a constant-gain characteristic, wherein a sum of the first window function and the second window function at each discrete point in time is one or at least approximates one, or wherein the signal which is present in the frequency-domain representation is filtered by a further filter with a further filter characteristic, wherein a combination signal from the filtered signal and the further filtered signal is formed, wherein the combination signal is provided with the frequency-domain window function in order to acquire a windowed combination signal, and wherein the windowed combination signal is combined with the filtered signal or the further filtered signal, and wherein a difference of the windowed signal and the further windowed signal is formed as the combination signal, and wherein the windowed combination signal is combined with the further filtered signal, and wherein the combined signal or a signal comprising a further signal in addition to the combined signal is converted to the time domain, or wherein the frequency-domain window function comprises a temporally increasing gain function or a temporally decreasing gain function, and wherein the windowed signal and the filtered signal are combined by means of a combiner, the combiner comprising: a first multiplier for multiplying the windowed signal by a first value; a second multiplier for multiplying the filtered signal by a second value; and a summer for summing up the multiplier output signals.

* * * * *